US007729626B2

(12) United States Patent
Kamoda et al.

(10) Patent No.: US 7,729,626 B2
(45) Date of Patent: Jun. 1, 2010

(54) APPARATUS AND METHOD FOR ADJUSTING CONCENTRATION OF LIQUID DEVELOPER

(75) Inventors: Yuji Kamoda, Ibaraki (JP); Keyaki Yogome, Otsu (JP); Hiroaki Umemoto, Neyagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 150 days.

(21) Appl. No.: 12/214,820

(22) Filed: Jun. 23, 2008

(65) Prior Publication Data

US 2008/0317489 A1 Dec. 25, 2008

(30) Foreign Application Priority Data

Jun. 25, 2007 (JP) ..... 2007-166239
Sep. 14, 2007 (JP) ..... 2007-239050

(51) Int. Cl.
*G03G 15/10* (2006.01)

(52) U.S. Cl. ..... 399/57

(58) Field of Classification Search ..... 399/57, 399/237, 238

See application file for complete search history.

(56) References Cited

U.S. PATENT DOCUMENTS 5,737,666 A * 4/1998 Lior et al. ..... 399/57
6,131,001 A 10/2000 Tsukamoto et al.
7,561,815 B2 * 7/2009 Kamijo et al. ..... 399/45

FOREIGN PATENT DOCUMENTS

| | | |
|---|---|---|
| JP | 06-277477 | 10/1994 |
| JP | 07-174607 | 7/1995 |
| JP | 09-281808 | 10/1997 |
| JP | 10-003221 | 1/1998 |
| JP | 11-073029 | 3/1999 |
| JP | 2004-322496 | 11/2004 |
| JP | 2006-154541 | 6/2006 |

* cited by examiner

*Primary Examiner*—Hoang Ngo
(74) *Attorney, Agent, or Firm*—Brinks Hofer Gilson & Lione

(57) ABSTRACT

In order to conform a specific correction table to the characteristics of a liquid developer to be used, the specific correction table is created by calibrating a standard correction table stored in advance by using a viscosity property value of a liquid developer for calibration at a current temperature. A concentration adjustment is performed by comparing a measured viscosity property value with a target viscosity property value which is temperature-corrected based on the specific correction table. Further, the viscosity property value of a liquid developer is detected by measuring the current of a motor for stirring the liquid developer, where a no-load stirring current value is measured in the absence of a liquid developer, and one or both of a measured current value and target current value is corrected based thereon.

21 Claims, 16 Drawing Sheets

APPARATUS AND METHOD FOR ADJUSTING CONCENTRATION OF LIQUID DEVELOPER

This application is based on Japanese Patent Applications No. 2007-166239 filed on Jun. 25, 2007, in Japanese Patent Office, and No. 2007-239050 filed on Sep. 14, 2007, in Japanese Patent Office, the entire contents of which are hereby incorporated by reference.

TECHNICAL FIELD

The present invention relates to an apparatus and a method for adjusting toner concentration of a liquid developer in which toner is dispersed in a carrier solution, wherein the viscosity of the liquid developer is used as a measure.

BACKGROUND

One of the products known in the conventional art is the image forming apparatus of electrophotographic process using a liquid developer. In such an image forming apparatus, an electrostatic latent image is formed on the photoreceptor and is developed using the liquid developer, whereby a toner image is formed. This toner image is transferred onto paper and is then fixed thereon.

The liquid developer is formed by dispersing toner of a high concentration made of resin and pigment in a carrier solution as an insulating solution such as silicone oil. When developing an electrostatic latent image using this liquid developer, a thin layer of developer in units of microns is formed on a developer carrier such as a development roller. This developer formed as a thin layer is brought in contact with a photoreceptor.

When a liquid developer is used for development as described above, it is important to form a uniform thin layer using a developer of a constant concentration in order to form images of constant concentration. To put it another way, the concentration of the liquid developer must be kept constant.

A method of calculating the developer concentration by detecting the light transmittance of the developer (Japanese Unexamined Patent Application Publication No. H09-281808, Japanese Unexamined Patent Application Publication No. H11-73029 and Japanese Unexamined Patent Application Publication No. H10-3221) is a technique known in the conventional art to measure the concentration of a developer for the purpose of maintaining the concentration of a liquid developer constant. However, a method of calculating the concentration of the developer by light transmittance has the disadvantage of poor accuracy in measuring the concentration of the highly concentrated developer. This is attributable to the fact that, when the concentration of the developer is low, the light transmittance exhibits a big change in response to changes in concentration, but when the concentration is high, the light transmittance is reduced and saturated.

The U.S. Pat. No. 6,131,001 discloses a technique of measuring the concentration of the highly concentrated developer using the viscosity thereof. The methods of measuring the viscosity of the developer adopted in the technique disclosed in this document include obtaining the viscosity from the difference in pressure of the developer in a pipe, installing a viscometer in the tank for storing the developer, and obtaining the viscosity from the torque resulting from the flowing developer. Further, the Japanese Unexamined Patent Application Publication No. 2006-154541 is provided with a concentration detecting rotary member in contact with the liquid developer. It discloses the art of obtaining the concentration of the developer by detecting the current or speed of the motor driving this rotary member. However, the method of using the developer viscosity has a disadvantage in that viscosity property value is changed if there is a change in the liquid developer temperature (hereinafter referred to as "liquid temperature" as well).

Thus, in the aforementioned Japanese Unexamined Patent Application Publication No. 2006-154541, a temperature sensor for detecting the liquid developer temperature is provided, and toner supply is controlled based on the 3D map representing the relationship between the motor current, toner concentration and temperature. However, the temperature characteristics are changed by a change in the type and lot of the liquid developer, and therefore, high-precision adjustment cannot be ensured by a fixed correction map.

The Japanese Unexamined Patent Application Publication No. 2004-322496 discloses the technique, wherein information on ink quality is indicated on the ink cartridge, and the image formation conditions are changed in response to the quality information. However, a great number of correction tables must be prepared to use this technique to correct the temperature characteristics of the liquid developer.

The Japanese Unexamined Patent Application Publication No. H07-174607 discloses an instrumental error correction apparatus of a flowmeter for kerosene and others. This instrumental error correction apparatus specifies the type of the fluid as an object to be tested. The instrumental error is corrected based on the viscosity correction data corresponding to the temperature for each type and the viscosity data corresponding to the current temperature. However, a great number of correction tables must be prepared to use this technique to adjust the concentration of the liquid developer.

SUMMARY

Thus, an object of the present invention is to solve the aforementioned problems and to provide an apparatus and method for adjusting the concentration of liquid developer in which high-precision correction is ensured by identifying the difference between liquid developers, even if there is a slight difference in the toner of liquid developer or a lot-to-lot fluctuation of toner, wherein the viscosity property is measured to adjust the concentration of the liquid developer.

Another object of the present invention is to provide an apparatus and method for adjusting the concentration of liquid developer wherein a simple mechanism is used to exchange the information on the liquid developer without the need of preparing a great number of correction tables.

A further object of the present invention is to provide an apparatus and method for adjusting the concentration of liquid developer wherein high-precision adjustment of the concentration of liquid developer is ensured by conducting easy temperature-correction proper to different liquid developers to calculate the viscosity property value.

A still further object of the present invention is to provide an apparatus and method for adjusting the concentration of liquid developer wherein, when the liquid developer is stirred, a current value of the motor for driving the stirring member is detected as a stirring load, whereby easy measurement is made for concentration adjustment, and possible causes for measurement error resulting from motor temperature characteristics are minimized to improve the concentration adjustment accuracy.

In view of forgoing, one embodiment according to one aspect of the present invention is a liquid developer concentration adjusting apparatus, comprising:

a concentration adjusting container;

a developer supplying mechanism which is connected to the concentration adjusting container and is adapted to supply the concentration adjusting container with a liquid developer whose concentration is to be adjusted;

a viscosity detector for detecting a viscosity property value which depends on concentration of a liquid developer in the concentration adjusting container;

a temperature detector for detecting a temperature of a liquid developer in the concentration adjusting container;

a memory which is adapted to store a standard correction table indicating a relationship between a viscosity property value of a predetermined standard liquid developer and temperature thereof;

a calibration portion which is adapted to correct the standard correction table to make a specific correction table based on outputs of the viscosity detector and the temperature detector while the concentration adjusting container is filled with a standard liquid developer for calibration;

a concentration adjusting mechanism which is adapted to adjust concentration of a liquid developer in the concentration adjusting container based on the temperature of the liquid developer in the concentration adjusting container and the specific correction table such that a viscosity property value of the liquid developer is a desired value.

According to another aspect of the present invention, another embodiment is a liquid developer concentration adjusting method for adjusting concentration of a liquid developer stored in a concentration adjusting container, the method comprising the steps of:

a first storing step of storing in a memory a standard correction table, on which a relationship between a viscosity property value of a predetermined standard liquid developer and temperature thereof;

a first measuring step of measuring a viscosity property value of a liquid developer for calibration and temperature thereof while the concentration adjusting container is filled with the liquid developer for calibration;

a second storing step of storing a specific correction table in the memory after creating the specific correction table by correcting the standard correction table based on the measured viscosity property value of the liquid developer for calibration and the measured temperature thereof;

storing in the concentration adjusting container a liquid developer whose concentration is to be adjusted;

a second measuring step of measuring a viscosity of liquid developer and temperature of the liquid developer whose concentration is to be adjusted; and an adjusting step of adjusting concentration, based on the temperature measured by the second measuring step and the specific correction table, such that the viscosity property value of the liquid developer, whose concentration is to be adjusted, to be a desired value for the measured temperature of the liquid developer whose concentration is to be adjusted.

According to another aspect of the present invention, another embodiment is a liquid developer concentration adjusting apparatus, comprising:

a concentration adjusting container;

a developer supplying mechanism which is connected to the concentration adjusting container and is adapted to supply the concentration adjusting container with a liquid developer whose concentration is to be adjusted;

a stirring mechanism which is adapted to stir a liquid developer stored in the concentration adjusting container, the stirring mechanism having a motor as a driving source, a load detector which is adapted to detect a current value of the motor to obtain a stirring load of the stirring mechanism;

a concentration adjusting mechanism which is adapted to adjust concentration of the liquid developer such that a current value detected by the load detector is a desired target value;

an empty load acquiring portion which is adapted to acquire a no-load stirring current which is an output of the load detector while the concentration adjusting container is empty; and a correcting portion which is adapted to correct a current value detected by the load detector and/or the desired target value based on the no-load stirring current, wherein the concentration adjusting mechanism adjusts the concentration of the liquid developer based on the current value and/or the target value corrected by the correcting portion.

According to another aspect of the present invention, another embodiment is a liquid developer concentration adjusting method for adjusting concentration of liquid developer to be a desired value by detecting a current of a motor included in a stirring mechanism for stirring a liquid developer stored in a concentration adjusting container, the method comprising the steps of:

acquiring a no-load stirring current value which is a current value of the motor while the concentration adjusting container is empty;

supplying the concentration adjusting container with a liquid developer whose concentration is to be adjusted;

detecting a current value of the motor while stirring the liquid developer stored in the concentration adjusting container with the stirring mechanism;

adjusting concentration of the liquid developer in the concentration adjusting container such that the detected current value is a desired value;

correcting, before the step of adjusting concentration, the detected current value and/or the target value by using the no-load stirring current; and discharging from the concentration adjusting container the liquid developer whose concentration has been adjusted.

DETAILED DESCRIPTION OF THE PREFERRED EMBODIMENT

The following describes an embodiment of the present invention with reference to the drawings:

(Structure and Functional Operation of Image Forming Section)

Figure 1:
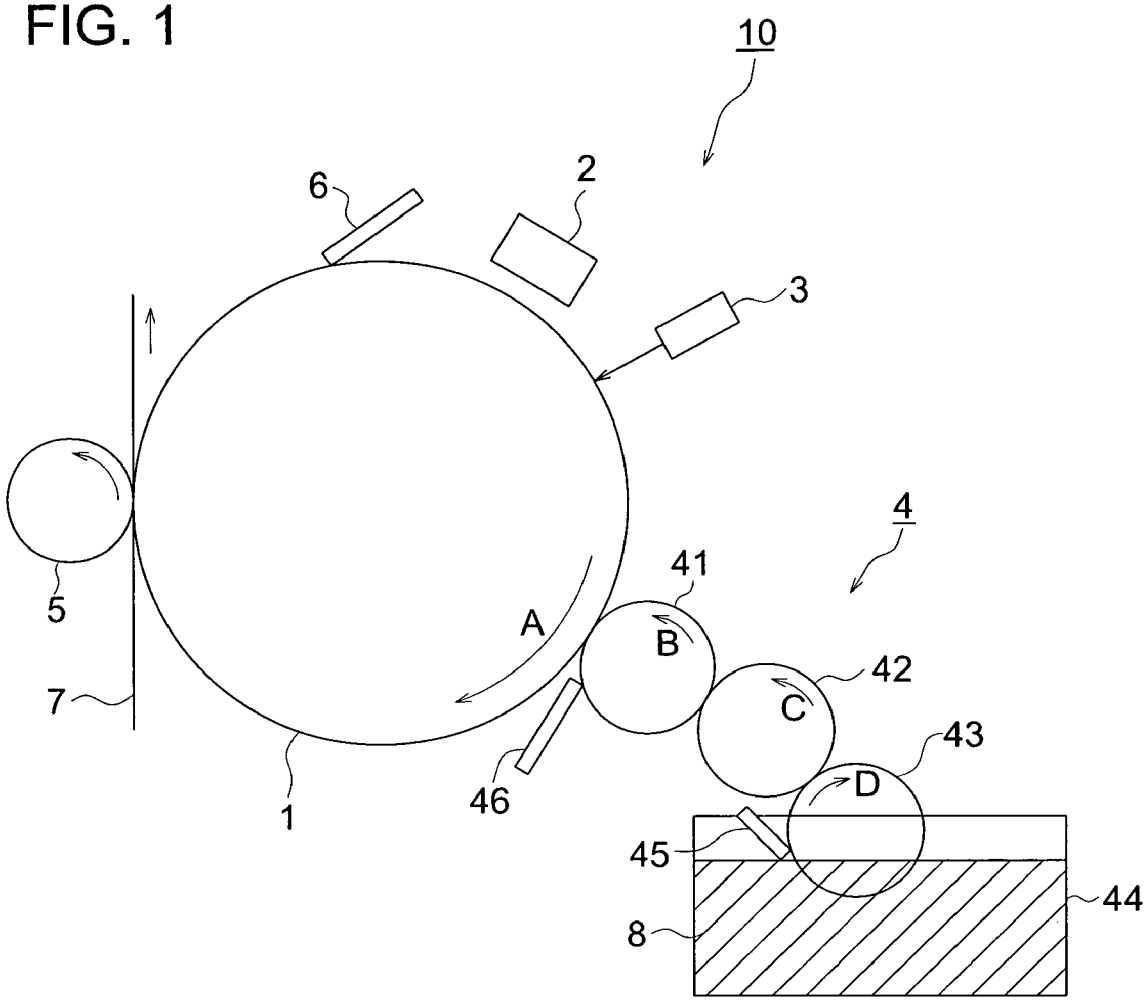
FIG. 1 is a cross sectional view representing an example of the schematic structure of the image forming section 10 of the image forming apparatus as an embodiment of the present invention.

FIG. 1 is a cross sectional view showing an example of the schematic structure of a wet type image forming apparatus as an embodiment of the present invention.

In FIG. 1, numeral 1 denotes a photoreceptor drum that serves as an image carrier. An image forming section 10 includes a charging apparatus 2 provided in the vicinity of the photoreceptor drum 1 for uniform charging of the surface of the aforementioned photoreceptor drum 1; an exposure apparatus 3 for forming an electrostatic latent image by applying LED or laser beam to the charged photoreceptor drum 1; a liquid development apparatus 4 for developing the electrostatic latent image with a liquid developer; a transfer apparatus 5 for transferring the developed toner image onto a transfer media 7; and a cleaning apparatus 6 for removing the liquid developer remaining on the surface of the photoreceptor drum after transfer.

Further, an apparatus for coating the photoreceptor drum 1 with a liquid developer in advance or an apparatus for recovering part of the extra liquid developer on the photoreceptor drum 1 may be installed before and after the liquid development apparatus 4. A recording material such as recording paper can be used as a transfer media 7. Alternatively, an intermediate transfer belt can be used as the transfer media 7 so that the image is transferred again onto a final recording material.

The liquid development apparatus 4 includes a development roller 41 that carries a thin layer of the liquid developer on its surface so as to develop the latent image on the photoreceptor drum 1 as an image carrier; a conveyance roller 42 which is in contact with the development roller 41 to transfer onto its surface the liquid developer whose amount is controlled; and a supply roller 43 which is in contact with the conveyance roller 42 for supplying its surface with the liquid developer 8 in the developer container 44.

In FIG. 1, only one liquid development apparatus 4 is installed, but more than one liquid development apparatus 4 can be installed for color image formation. A desired color development method may be used, and the use or non-use of intermediate transfer may be determined as desired. A desired structure can be arranged depending on such options.

The photoreceptor drum 1 rotates in the arrow direction A in FIG. 1. The charging apparatus 2 charges the surface of the rotating photoreceptor drum 1 up to several hundred volts by corona discharge. On the downstream side of the charging apparatus 2 in the rotating direction of the photoreceptor drum, an electrostatic latent image whose surface potential is the level of a hundred volts which is reduced by the laser beam applied by the exposure apparatus 3.

A liquid development apparatus 4 is installed on the downstream side of the exposure apparatus 3, and the electrostatic latent image formed on the photoreceptor drum 1 is developed by the liquid developer 8.

In the liquid development apparatus 4, a liquid developer 8 made of insulating solvent (hereinafter also referred to as "carrier solution") and toner particles dispersed therein is stored in the developer container 44, and the liquid developer 8 is supplied to the surface of the conveyance roller 42 by way of the supply roller 43.

The conveyance roller 42 conveys a thin layer of the liquid developer 8 and transfers it onto the development roller 41. A thin layer of liquid developer 8 is carried on the development roller 41. Further, the toner particles in the thin layer of liquid developer 8 carried on the development roller 41 is moved to the electrostatic latent image on the photoreceptor drum 1 by the potential difference between electrostatic latent images on the development roller 41 and photoreceptor drum 1, whereby an electrostatic latent image is developed.

The transfer apparatus 5 charges the transfer media 7 which is conveyed at the same speed as the peripheral speed of the photoreceptor drum 1, or applies voltage thereto, whereby the toner image developed on the photoreceptor drum 1 is transferred onto the transfer media 7.

A cleaning apparatus 6 for removing the liquid developer remaining on the surface of the photoreceptor drum 1 is installed on the downstream side of the transfer apparatus 5. The liquid developer 8 remaining on the photoreceptor drum 1 is removed by the cleaning apparatus 6.

The transfer media 7 with a toner image transferred thereon by the transfer apparatus 5, if it is a recording material, is fed to the fixing apparatus (not illustrated) and is heated to fix the image. If the transfer media 7 is an intermediate transfer media such as an intermediate transfer belt, the toner image is transferred again onto the recording material. The recording material with the toner image transferred thereon is fed to the fixing apparatus wherein the image is fixed, and the material is ejected.

(Developer Composition)

The following describes the liquid developer 8 used for development. In the liquid developer 8, colored toner particles are dispersed in a carrier solution as a solvent at a high concentration. Additives such as a dispersant and charge regulating agent can also be added to the liquid developer 8.

The insulating solvent which is nonvolatile at the normal temperature is used as the carrier solution. Toner particles are mainly made of resin and pigment or dye for coloring purposes. The resin has a function of uniformly dispersing the pigment or dye in itself and a function as a binder when fixing the image on the recording material.

The volume-average particle diameter of the toner is preferably in the range of 0.1 μm or more without exceeding 5 μm. If the toner average particle diameter is below 0.1 μm, development performances are much deteriorated. If the average particle diameter is over 5 μm, the image quality is deteriorated.

The percentage of the mass of toner particles to the mass of the liquid developer is preferably in the range of about 10 through 40%. If it is below 10%, toner particles tend to settle out, and this causes the problem of stability with time when stored for a long time. Further, to get required image concentration, a large quantity of developer must be supplied, and this will increase the amount of carrier solution attached on paper. The paper must be dried at the time of fixing, and environmental problem occurs due to the evaporated vapor. If this percentage is over 40%, the viscosity of the liquid developer will be excessive, and handling difficulties and difficulties in the manufacturing process will occur.

(Structure and Operation of Development Apparatus)

Figure 2:
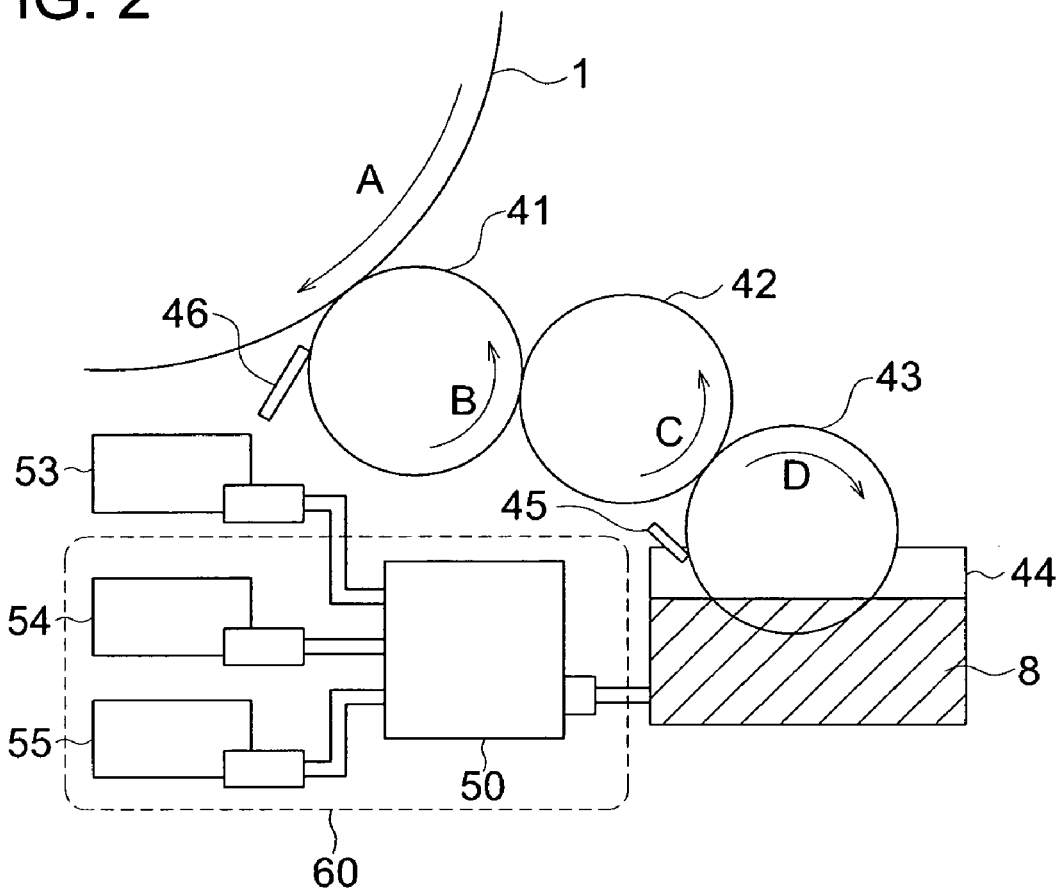
FIG. 2 is a layout drawing representing the schematic structure of the liquid development apparatus 4 of FIG. 1.

FIG. 2 shows the schematic structure of the liquid development apparatus 4.

The developer container 44 accommodates the liquid developer 8.

The supply roller 43 is arranged to be partially immersed in the liquid developer 8 in the developer container 44. Rotating in the arrow-marked direction D, this roller draws up the liquid developer 8 from the developer container 44. The high-viscosity liquid developer 8 is fed as it is attached to the surface of the supply roller 43 by its adhesibility.

The regulating member 45 is arranged so as to be in contact with the supply roller 43 in the counter direction to the rotating direction, as illustrated. It is intended to regulate the amount of the developer attached on the surface of the supply roller 43 to be fed. This arrangement peels off the excess amount of developer, and a thin layer of developer is formed on the surface of the supply roller 43, and the developer is then fed to the next conveyance roller 42.

A rubber roller is generally used as a conveyance roller 42. The conveyance roller 42 is arranged face to face with the supply roller 43 and is rotated in the arrow-marked direction C in contact therewith. At this nip portion, a thin layer of developer formed on the surface of the supply roller 43 is transferred onto the surface of the conveyance roller 42 and is fed toward the development roller 41.

A low-hardness rubber roller is used as the development roller 41. The development roller 41 is arranged face to face with the conveyance roller 42, and is rotated in the arrow-marked direction B in contact therewith. At this nip portion, a thin layer of developer fed by the surface of the conveyance roller 42 is scraped off by the development roller 41, and a thin layer of developer is carried and fed by the surface of the development roller 41. Thus, the development roller 41 functions as the developer carrier.

In this case, the conveyance roller 42 forms a thin layer of developer and transfers it to the developer carrier. Alternatively, the supply roller 43 may be designed to serve this function as well. To put it another way, it is possible to adopt the method wherein the developer is transferred from the supply roller 43 directly to the development roller 41.

The development roller 41 is rotated in contact with the photoreceptor drum 1 as an image carrier, and the latent image on the photoreceptor 1 is developed by the thin layer of developer fed to the nip portion between the development roller 41 and the photoreceptor drum 1, namely the development area.

However, after the latent image on the photoreceptor drum 1 has been developed, a thin layer of developer remains on the surface of the development roller 41. When the remaining developer is fed to the development area again without being removed, the next development may be adversely affected. The removing member 46 is a cleaning blade to remove the remaining developer.

(Structure for Collecting and Recycling the Developer)

FIG. 2 also shows the schematic structure for collecting and recycling the removed remaining developer in the liquid development apparatus 4.

As described above, the developer remaining on the development roller 41 is removed by the removing member 46. The recovered developer is collected in a container to be discarded, or to be reused. The present embodiment employs a configuration which does not need a container for discarding and is able to efficiently use the developer by reusing the recovered developer.

The developer having been scraped off from the surface of the development roller 41 by the removing member 46 is stored in the recovered developer container 53 as the recovered developer.

The recovered developer stored in the recovered developer container 53 is fed to the developer concentration adjusting apparatus 60 so that its concentration is adjusted to the desired concentration and is reused. The recovered developer container 53 is provided with a recovered developer supply mechanism 53*a*. This recovered developer supply mechanism 53*a* is designed to feed the recovered developer to the developer concentration adjusting apparatus 60, and a normal pump capable of drive control can be used as this mechanism.

The recovered developer having been adjusted to the desired concentration in concentration by the developer concentration adjusting apparatus 60 is conveyed to the developer container 44 of the liquid development apparatus 4, wherein it is reused. Further, there can be provided a supply container in which the recovered developer having been adjusted to the desired concentration in concentration is temporally stored, and from which it is supplied to the developer container 44.

<Structure of the Developer Concentration Adjusting Apparatus>

Figure 3:
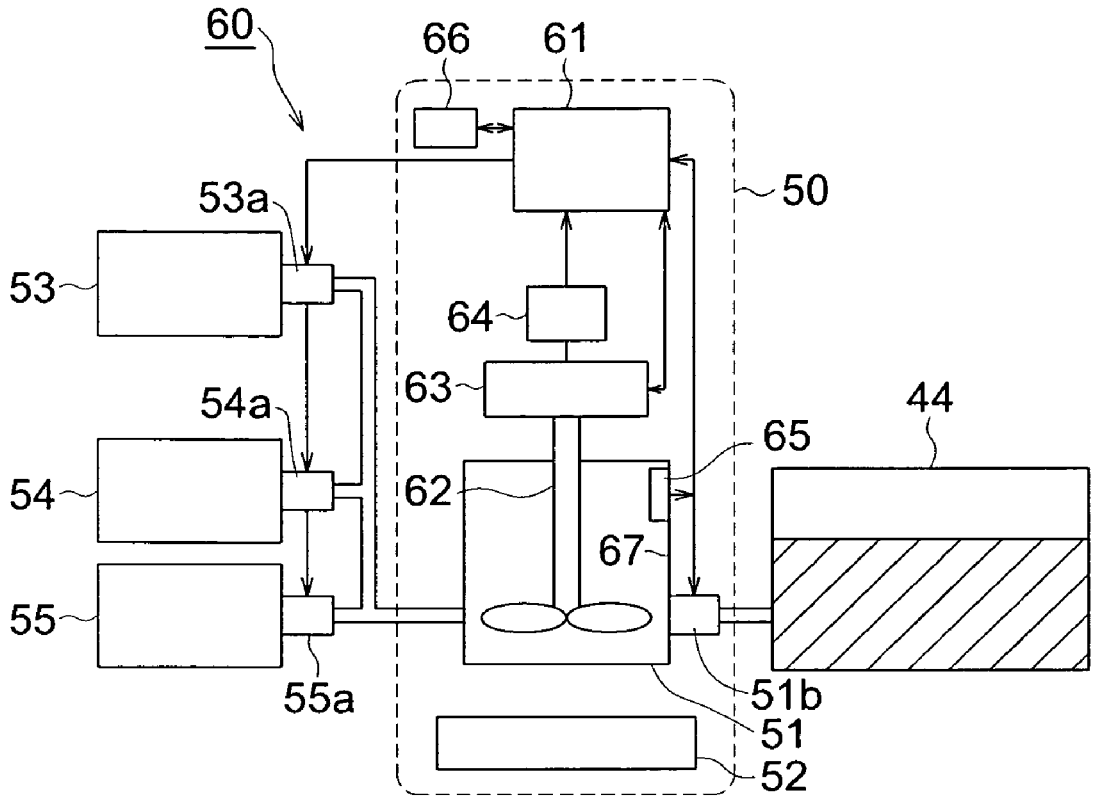
FIG. 3 is a layout drawing representing the schematic structure of the developer concentration adjusting apparatus 60 of FIG. 2.

The schematic structure of the developer concentration adjusting apparatus 60 of FIG. 2 is again shown in FIG. 3.

The developer concentration adjusting apparatus 60 includes, as the concentration adjusting mechanism of the present invention, a developer concentration measuring section 50, first supply developer container 54, first liquid supplying mechanism 54*a*, second supply developer container 55 and second liquid supplying mechanism 55*a*.

The first supply developer container 54 stores the liquid developer of a concentration higher than the desired concentration, as the first supply developer. The developer is supplied to the developer concentration measuring section 50 by the first liquid supplying mechanism 54*a*. A normal pump capable of drive control can be used as the first liquid supplying mechanism 54*a*.

The second supply developer container 55 stores the liquid developer (including the case of carrier solution alone) of a concentration lower than the desired concentration as the second supply developer, for example, and this developer is sent to the developer concentration measuring section 50 by the second liquid supplying mechanism 55*a*. A normal pump capable of drive control can be used as the second liquid supplying mechanism 55*a*.

The first supply developer container 54 and second supply developer container 55 function as supply mechanisms.

In the developer concentration adjusting apparatus 60, the recovered developer having been fed for concentration adjustment is sent to the developer concentration measuring section 50 as a developer whose concentration is to be adjusted (hereinafter, referred to as a concentration-adjusting developer).

The developer concentration measuring section 50 measures the concentration (actually the viscosity property value, in other words, a current of the motor as a stirring load corresponding to the viscosity) of the concentration-adjusting developer. The first liquid supplying mechanism 54*a* or the second liquid supplying mechanism 55*a* is driven in response to the result of comparison between the measured concentration and the desired concentration (a desired current value, in other words, a target viscosity property value), whereby the first supply developer or the second supply developer is supplied. To put it another way, if the concentration is lower than the desired concentration, the developer (first supply developer) of higher concentration is supplied. If the concentration is higher than the desired concentration, the developer (second supply developer) of lower concentration is supplied.

In the developer concentration adjusting apparatus 60, measurement of the concentration by the aforementioned developer concentration measuring section 50 and the supply of the supply developers are continued until the concentration of the concentration-adjusting developer reaches the desired concentration.

When the concentration of the concentration-adjusting developer has reached the desired concentration, concentration adjusting procedure terminates. The concentration-adjusting developer having been adjusted in concentration is supplied from the developer concentration adjusting apparatus 60 to the developer container 44 of the liquid development apparatus 4.

<Structure of Developer Concentration Measuring Section>

The developer concentration measuring section 50 includes a concentration adjusting container 51, ejected developer container 52, controller 61, stirring member 62, drive section 63, load detector 64, temperature detector 65, and memory 66.

The concentration adjusting container 51 is used to store the concentration-adjusting developer, and to adjust the concentration. Driven by the drive section 63, the stirring member 62 stirs the concentration-adjusting developer in the concentration adjusting container 51, and the load is detected by the load detector 64, whereby the concentration is measured.

Figure 4:
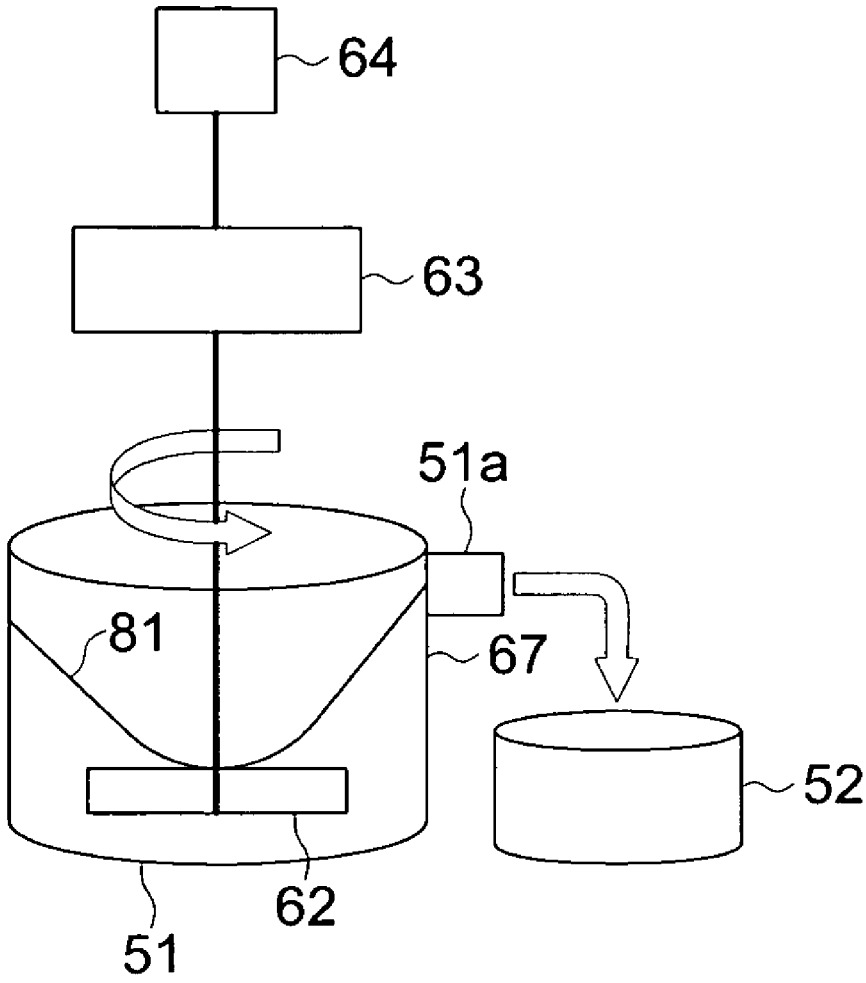
FIG. 4 is an apparatus structure drawing representing the operation of the developer concentration measuring section 50 of FIG. 3.

FIG. 4 shows the schematic structure of the developer concentration measuring section 50.

The concentration adjusting container 51 is a cylindrical container, and an opening 51*a* is arranged on the side of the upper portion, which is a wall 67 of the present invention. When the liquid level has become higher than the opening due to an increase of the amount of the stored concentration-adjusting developer, the excess amount of the developer flows out the opening, and thus, the opening 51*a* keeps the highest liquid level of the concentration-adjusting developer at a constant level. Further, the entire top end of the concentration adjusting container 51 may define an opening to let excessive concentration-adjusting developer overflow from the whole of the top end. The concentration adjusting container 51 is provided with a developer supply mechanism 51*b* (FIG. 3). This developer supply mechanism 51*b* is designed to feed the concentration-adjusted developer to the developer container 44. A normal pump capable of drive control can be used as the developer supply mechanism 55*b*.

The ejected developer container 52 receives the aforementioned overflowing concentration-adjusting developer, and stores it. It is possible to make such arrangements that the liquid developer remaining in the ejected developer container 52 is discarded, or is used as a recovered developer to be subjected to concentration adjustment. Alternatively, the apparatus may have a configuration in which the ejected developer is directly returned to the recovered developer container 53 without the ejected developer container 52.

The stirring member 62 is a stirring blade, for example. It is installed inside the concentration adjusting container 51, and is driven and rotated by the drive section 63, whereby the stored concentration-adjusting developer is stirred. The drive section 63 is a motor, for example, and is used to rotate the stirring blade as a stirring member 62 under predetermined conditions.

The load detector 64 is an apparatus to detect the load for driving the stirring member 62 by a drive section 63. The drive section 63 and stirring member 62 serve as a stirring mechanism in the present invention.

The load detector 64 as the viscosity detector or the load detector of the present invention uses the ammeter for measuring the current value required to drive the motor under a predetermined condition as a load for rotating the rotary blade by the motor. The current value measured in this case is the viscosity property value representing the viscosity.

The temperature detector 65 is a temperature sensor, for example, and is installed inside the concentration adjusting container 51 to detect the liquid temperature of the concentration-adjusting developer. The liquid temperature of the concentration-adjusting developer is sent to the controller 61, and is used to the temperature correction of viscosity property value.

The memory 66 stores a standard correction table for temperature correction of the viscosity property value. It also stores the specific correction table created according to the standard correction table. These tables are referenced, created or stored by the controller 61. The memory 66 serves as a correction table storing section.

The controller 61 controls the operation of these components and obtains the concentration of the concentration-adjusting developer or a current value corresponding to the concentration, i.e., viscosity property value. Based on the obtained viscosity property value and liquid temperature, the controller 61 as the calibrating portion of the present invention calibrates the standard correction table and creates a specific correction table. The controller 61 can be made up of a microcomputer, memory and the like.

The controller 61 also controls the supply operation of the supply mechanism for concentration adjustment based on the comparison between the concentration of the concentration-adjusting developer and the desired concentration (or target viscosity property value corresponding thereto).

Further, the controller 61 controls creation of the aforementioned specific correction table (at the time of calibration) for the temperature correction, as well as calculation and comparison of target viscosity property value (at the time of measurement). The details will be described later.

The aforementioned developer concentration measuring section 50 is designed in such a way that the load detector 64 detects the motor current value as the load when the stirring member 62 such as a stirring blade is used to stir the concentration-adjusting developer, wherein the motor current value is detected as the viscosity property value. Thus, the concentration is calculated. This is based on the fact that the viscosity varies with the concentration of the concentration-adjusting developer, and the stirring load varies therewith.

The liquid developer is formed in such a way that toner is dispersed in a carrier solution as described above. The concentration of the liquid developer is expressed by the concentration of toner in the developer.

The viscosity changes with change in the concentration of the developer. The viscosity changes specifically in the high concentration region. This provides a sufficient sensitivity for measurement in that region.

The change in the viscosity of the developer also causes a change in the load required to stir the developer. This can be used to measure the viscosity, hence concentration.

To get the load of stirring, it is convenient to measure the current value of the motor used to drive the stirring blade or the like. In this case, an ammeter can be used to measure the current value required to cause rotation at a predetermined speed.

<Control of Quantity of the Liquid Developer Whose Concentration is to be Adjusted>

One possible method to get the viscosity from the load of stirring includes keeping the condition of the stirring constant. The conditions of the apparatus, as well as the rotation condition of the stirring blade and the quantity of the liquid developer are kept constant.

However, the present embodiment does not employ the method where the quantity of liquid at the time of stirring is kept always constant regardless of the viscosity. Instead, the arrangement of the present embodiment is made such that the quantity of the developer at the time of stirring is the same if the viscosity of the developer is the same. To be more specific, the wall 67 of the concentration adjusting container 51 is provided with an opening 51*a* to cause excessive developer to overflow.

As is apparent from FIG. 4, liquid developer is outwardly moved by centrifugal force of the rotation of the stirring blade, and the liquid level 81 forms a big funnel shape.

Thus, due to the opening 51*a*, the upper surface of excessive liquid developer is restricted on the outermost side. This means that the quantity of liquid is controlled depending on the developer viscosity.

In this case, if the developer of the same viscosity is utilized, liquid level is regulated by the opening 51*a*, whereby the same liquid surface situation of the same funnel shape is formed, hence the same quantity of liquid is measured.

It goes without saying that the quantity of liquid varies depending on the viscosity of the developer, but different quantities of liquid, i.e., predetermined quantities of liquid are measured depending on different viscosities respectively. This makes it possible to relate the stirring load with the quantity of liquid which corresponds to viscosity.

The aforementioned arrangement eliminates the need of controlling the quantity of liquid to be the same quantity every time the viscosity is measured. The required control is performed automatically by the opening 51*a*. Even if the developer of different concentration is supplied during the measurement, the quantity of liquid is automatically controlled in response to the change in viscosity.

<Temperature Correction of the Current Value as Viscosity Property Value>

The current value of the motor used to drive the stirring blade is measured as the viscosity property value. The stirring blade is driven at a predetermined speed and the current value in this case is measured by the ammeter.

A motor current value (viscosity property value) is measured in advance as the load of stirring when the developer of a desired concentration is stirred, and this value is stored as a target current value (target viscosity property value). The current value measured at the time of stirring the concentration-adjusting developer is compared with the stored target current value, and the first developer or the second developer will be supplied depending on the result of the comparison.

Alternatively, a tolerance may be added to the target current value to form a target current value range, and the concentration adjustment is terminated when the value falls within this range, and the first developer or the second developer may be supplied depending on whether the value i higher or lower the target range.

In actual practice, however, the motor current value exhibits a considerable fluctuation depending on the temperature of the liquid developer to be stirred. This is because the viscosity itself is changed by the liquid temperature, even if there is no change in the concentration of the liquid developer.

Figure 5A:
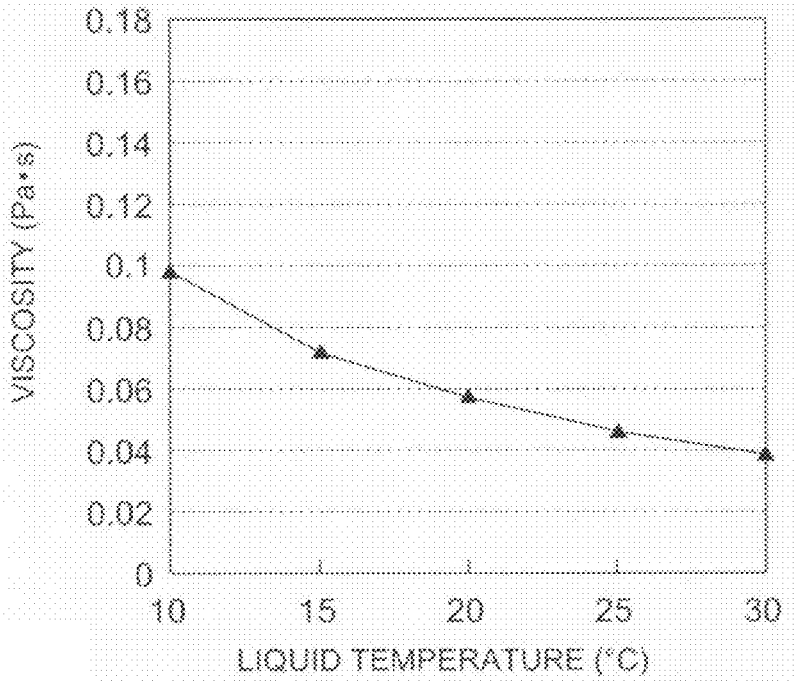
FIG. 5*a* is a chart representing the relationship between temperature and viscosity of a liquid developer.

FIG. 5*a* is a chart representing the relationship between the temperature and viscosity of the liquid developer. The viscosity is reduced as the liquid temperature rises.

Figure 5B:
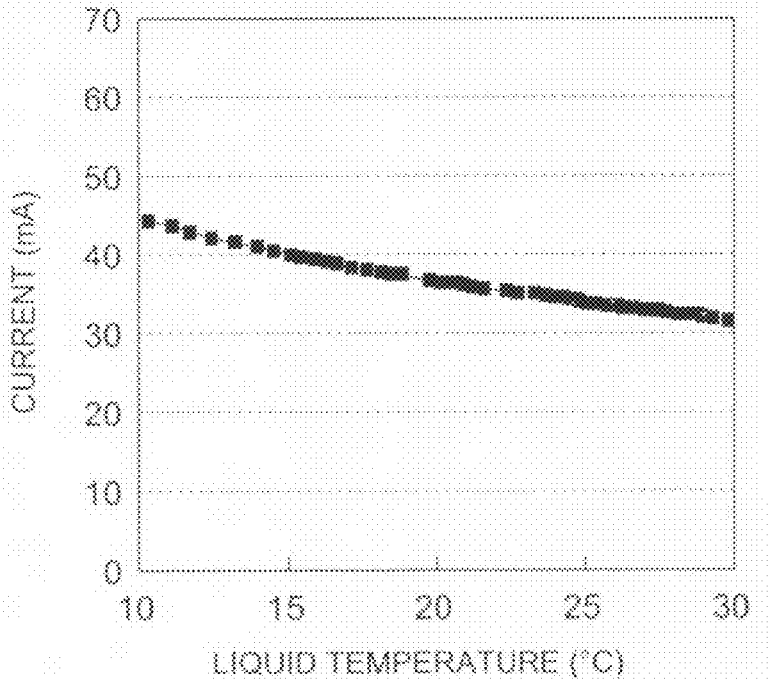
FIG. 5*b* is a chart representing the relationship between liquid temperature and a current value (viscosity property) of the standard developer.

FIG. 5*b* shows the relationship between the temperature and the current value (viscosity property value) of the liquid developer of the desired concentration (hereinafter referred to as "standard developer"). The current value as a viscosity property value is a characteristic value representative of viscosity. Thus, FIG. 5*b* exhibits the same trend as FIG. 5*a*.

The aforementioned target current value stored for concentration adjustment is inadequate in some cases, or, when viewed from another point of view, the current value having been measured is inadequate. To be more specific, if the liquid temperatures are different between the cases wherein the target current value is measured and the current for the concentration-adjusting developer is measured, it is necessary to correct one of them to provide consistency on a temperature basis.

To correct the change in the temperature of liquid developer, all that have to be done is quantitatively recognize how much the current value changes depending on the temperature change. For example, the relationship of FIG. 5*b* is obtained and a correction table is created in advance. In actual measurement, the temperature of the concentration-adjusting liquid developer is measured, and a current value, for that temperature, picked up from the correction table is set as the target value.

However, the relationship between the liquid temperature and current value (viscosity property value) of FIG. 5*b* changes with the type of developer. This makes it necessary to change the correction table every time the developer is changed.

Figure 6A:
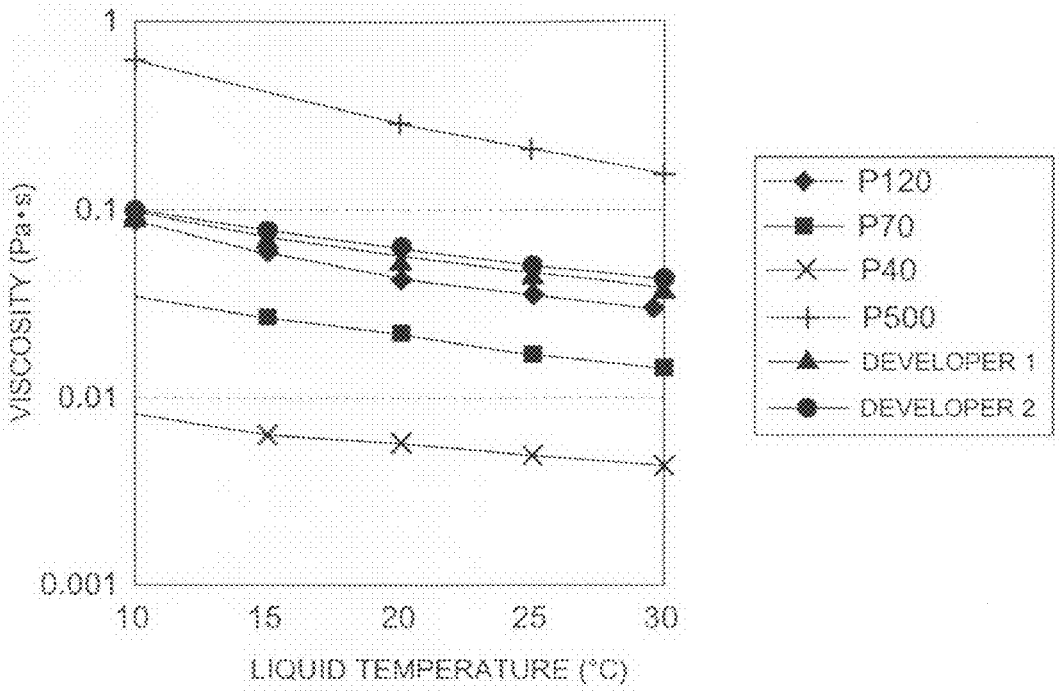
FIG. 6*a* is a chart representing the relationship between liquid temperature and viscosity of each liquid.

FIG. 6*a* is a chart representing the relationship between liquid temperature and viscosity of various types of liquid carrier and liquid developer. Carrier solutions P40, P70, P120 and P500 are different, and two types of developers are made up of the same carrier solutions P70 with toner added thereto.

FIG. 6*a* shows that different correction tables must be prepared for different liquids. Otherwise, correction cannot be made.

Figure 6B:
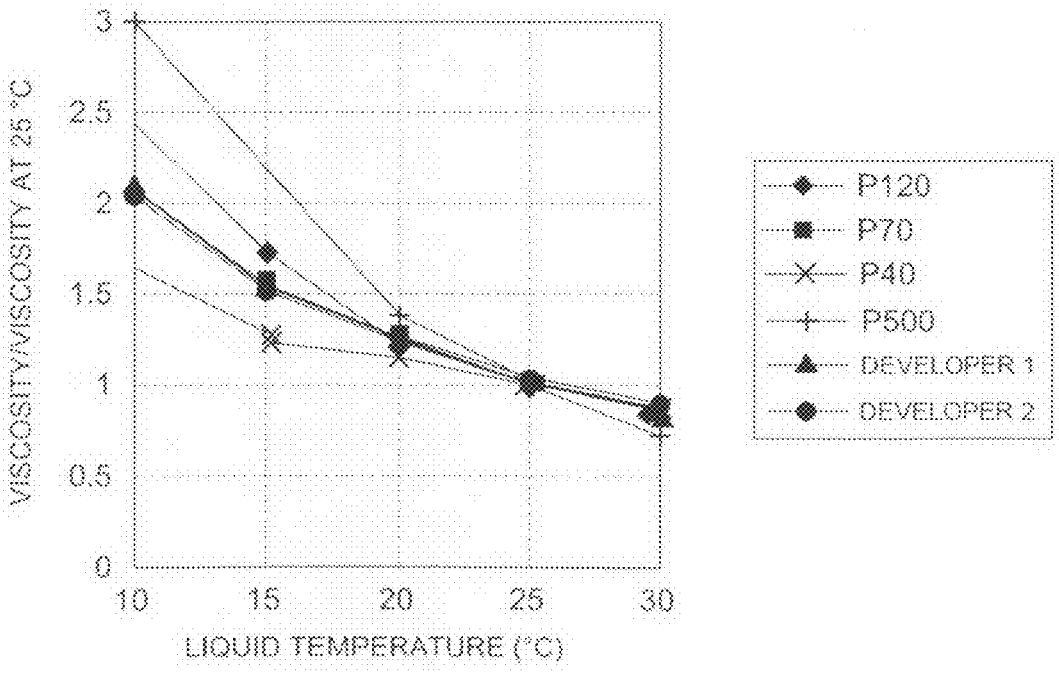
FIG. 6*b* is a chart representing the normalized form of the relationship of FIG. 6*a;*

FIG. 6*b* is a chart representing the normalized form of the relationship of FIG. 6*a*, wherein the viscosities are normalized as "1" for the liquid temperature of 25° C. In FIG. 6*b*, the lines for different carrier solutions do not overlap, but the two developers and carrier solution P70 without toner overlap.

To be more specific, the chart is not applicable to the cases wherein the type of the carrier solution has been changed. However, when one and the same carrier solution is used, the change rate of viscosity for the change in temperature is constant.

To be more specific, the relational expression of viscosity=f (liquid temperature), which is the relationship between the liquid temperature and viscosity, can be approximated by the formula of viscosity'≈a×f (liquid temperature) if the developer is different from the standard one (wherein "a" indicates the constant to be determined by the developer). This relationship can be approximated when the solvent is the same, and only the type of toner is different, as in the case of liquid developer.

The physical properties of the developer change according to the manufacturing conditions. In particular for toner, the toner exhibits variations in physical properties depending on the differences in resin material, particle size, dispersion and type of the pigment, even if it is supposed to be equally manufactured. In the meantime, the carrier solution exhibits almost no variation. Thus, the carrier solution is hardly changed by the variation in the production of the developer. Only the toner is changed. Accordingly, the aforementioned relationship applies to the variation in the production of the liquid developer.

Figure 7A:
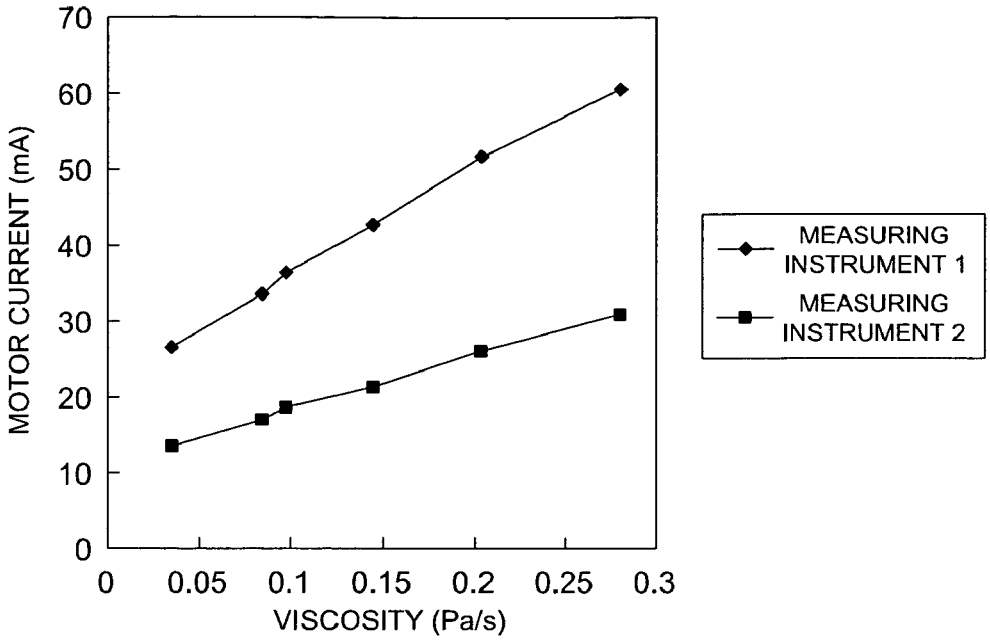
FIG. 7*a* is a chart representing the relationship between liquid viscosity and a motor current value (viscosity property value) at the time of stirring.
Figure 7B:
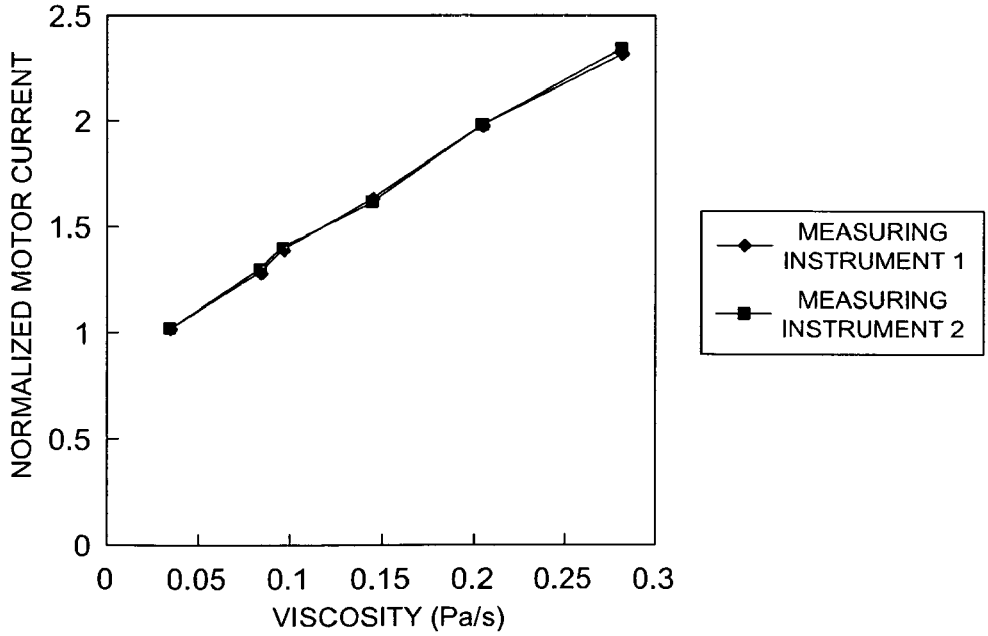
FIG. 7*b* is a chart representing the relationship between liquid viscosity and a motor current value normalized by the current value at the minimum viscosity.

FIG. 7*a* is a chart representing the relationship between the liquid viscosity and motor current value (viscosity property value) at the time of stirring. The measuring instruments 1 and 2 indicate different measuring apparatuses. FIG. 7*b* is a chart where the current values of each measurement apparatus in FIG. 7*a* are normalized by each of the current values at the minimum viscosity.

FIG. 7*a* shows that the current value is approximately proportional to viscosity. FIG. 7*b* indicates that the relationship of current value relative to viscosity is proportional, which means that even when the apparatus is different, the current value is proportional to viscosity.

To be more specific, the relational expression of current value=g (viscosity), which is the relationship between the viscosity and current value (viscosity property value), can be approximated by the formula of current value'≈b×g (viscosity) (wherein "b" denotes the constant specific to the apparatus), if different apparatuses are used.

The following summarizes the aforementioned relationship between the liquid temperature and viscosity, and the relationship between the viscosity and current value:

The relational expression of current value=h (liquid temperature), which is the relationship between the liquid temperature and current value, can be approximated by the formula of current value'≈a×b×h (liquid temperature)=C×h (liquid temperature), if the developer and apparatus are different from standard ones. The constant C denotes a constant combed of the correction factor of toner and the correction factor of the measuring apparatus.

Based on this relationship, temperature correction is done using the correction table.

(Temperature Correction Table)

As described above, concentration is adjusted using the viscosity property value by comparison with the target viscosity property value corresponding to the liquid developer of the desired concentration. Using the correction table, the target viscosity property value is corrected and set as the target viscosity property value at the same temperature as that of the liquid temperature measured at the time of concentration adjustment.

The correction table is created in advance using the standard developer. However, giving consideration to a possible change of the developer and apparatus, the table is created again by calibrating the original correction table using the actually used apparatus and the actually used developer. For calibration, the table can be created by simple conversion using the aforementioned proportional relationship merely obtaining the viscosity property value at the temperature of the developer of a desired concentration at the time of the calibration.

The following describes the procedure:

1. Creation of Standard Correction Table

A common standard correction table (representing the relationship between the liquid temperature and reference current value) is created in advance using a common apparatus and a common standard developer at the time of shipment of the apparatus from a factory. This is stored in each apparatus as data. This indicates the relational expression between the liquid temperature and current value of the already described standard developer, reference current value=h (liquid temperature). This serves as a basis for creating a specific correction table by performing the following calibration in each apparatus.

2. Calibration and Creation of Specific Correction Table

Calibration is performed, at an appropriate timing such as changing the developer cartridge, using the new liquid developer (developer for calibration) in each apparatus. In calibration, the liquid temperature and current value are measured in the specific apparatus with a specific developer. A specific constant is calculated by referencing the data on the standard correction table, and the data of the standard correction table is multiplied by a specific constant, whereby the specific correction table is created.

The specific constant is "C" in the relational expression of current value'≈C×h (liquid temperature), which is used in the case where the developer and apparatus to be used are different from the standard ones. It can be obtained by the calculation of C=current value'/h(liquid temperature at the time of calibration). The specific correction table (target current value=C×h (liquid temperature)) is obtained by multiplying the data on the standard table (indicating the current value=h (liquid temperature)) by the specific constant C.

3. Temperature Correction for Concentration Adjustment

The current value and liquid temperature are measured at the time of concentration adjustment, and the temperature-corrected target current value is obtained from the specific correction table. Then the measured current value is compared with the temperature-corrected target current value, whereby the concentration is adjusted.

The temperature-corrected target current value for the liquid temperature at the concentration adjustment can be obtained from the specific correction table indicating the aforementioned target current value in the equation of target current value=C×h (liquid temperature).

Figure 8A:
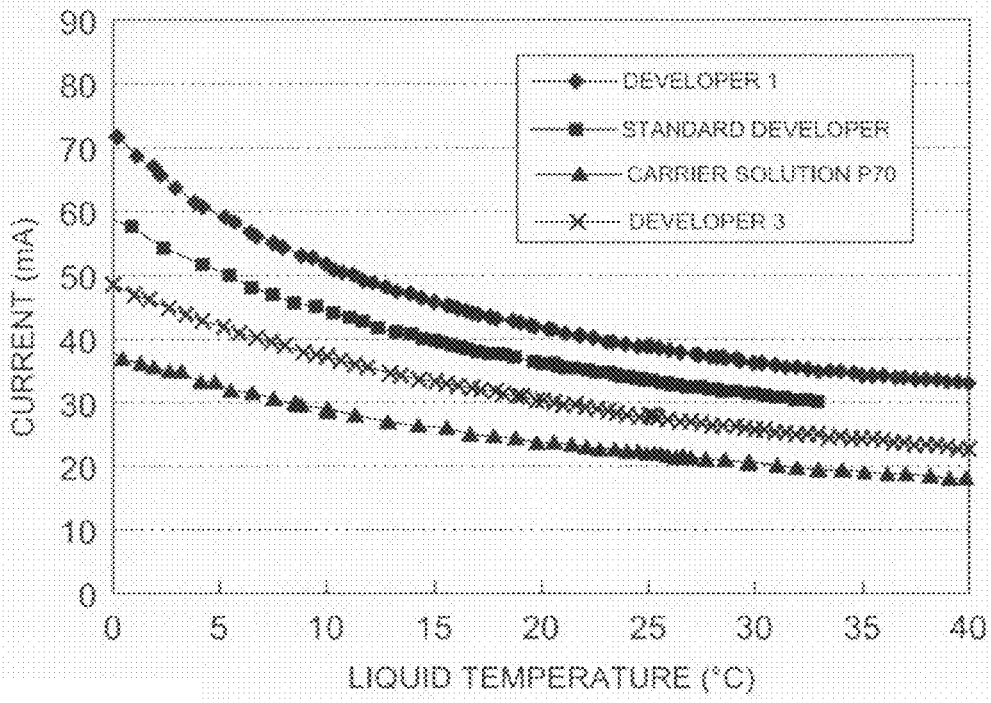
FIG. 8*a* is a chart showing the relationship between the liquid temperature and current value of different developers.

FIG. 8*a* is a chart showing the relationship between the liquid temperature and current value for different developers. This relationship for the standard developer makes the standard correction table.

Figure 8B:
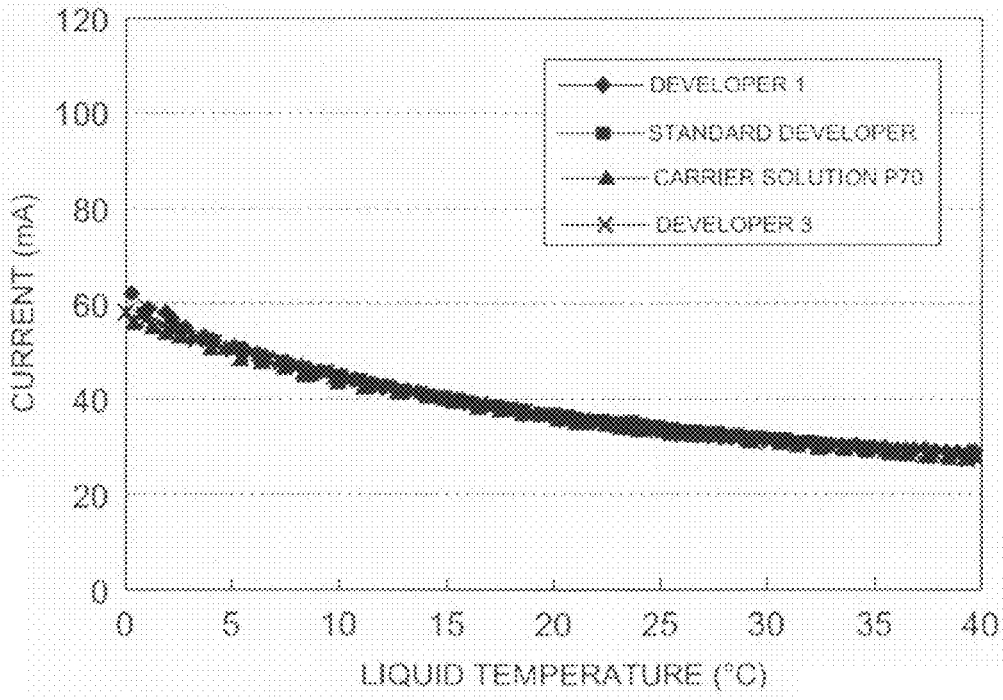
FIG. 8*b* is a chart showing them normalized by the temperature during correction in conformity to the standard correction table.

In FIG. 8*b*, the relationship of FIG. 8*a* for each developer is normalized by the standard correction table for the liquid temperature at the time of calibration. In this case, the relationship of each developer is conformed to the relationship of the standard developer assuming the liquid temperature at the time of calibration as 25° C. To put it another way, the relational expression of each developer is multiplied by the reciprocal of each specific constant C.

The relationship between the temperature of each liquid developer and current value is almost in complete conformance with the relationship of the standard developer. To put it another way, the specific correction table can be created by conversely multiplying the standard correction table by the specific constant, whereby the relationship between the target current value and liquid temperature of the concerned developer can be obtained properly.

The following describes the details of the procedure for temperature correction using the correction table in the processing of concentration adjustment:

<Creation of Standard Correction Table>

Figure 9:
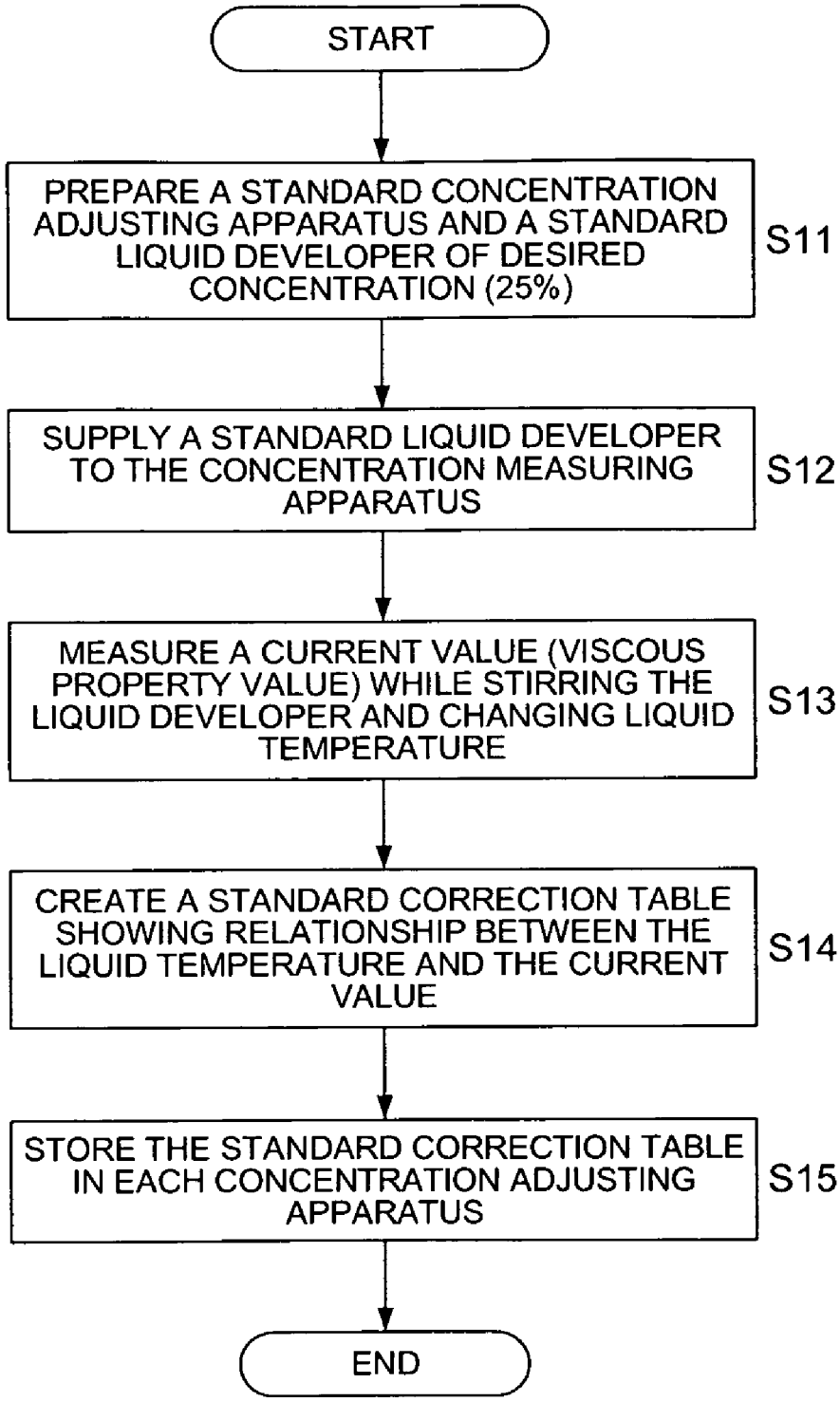
FIG. 9 is a flow chart showing the procedure of creating the standard correction table.

FIG. 9 is a flow chart showing the procedure of creating the standard correction table.

In the first place, a concentration adjusting apparatus as a standard and a developer of a desired concentration as a standard (wherein toner concentration is 25% in the present embodiment) are prepared in Step S11. These are supposed to be the standard apparatus and standard developer for creating the standard correction table.

In Step S12, the liquid developer of a desired toner concentration (standard developer) is supplied to the standard apparatus.

In Step S13, temperatures of the standard liquid developer are measured while changing the liquid temperature. At the same time, the standard developer is stirred and the motor current values (viscosity property value) at each of the measured liquid temperatures are measured (first measuring step).

In Step S14, the standard correction table showing the relationship between the measured liquid temperature and viscosity property value (standard viscosity property value) is created. This represents the aforementioned relational expression of current value=h (liquid temperature), which is the relationship between the liquid temperature and current value.

In Step S15, the standard correction table having been created is stored in the memory of each apparatus (developer concentration adjusting apparatus) (first storing step).

This concludes the description of the procedure of creating the standard correction table.

<Calibration and Creation of Specific Correction Table>

Figure 10:
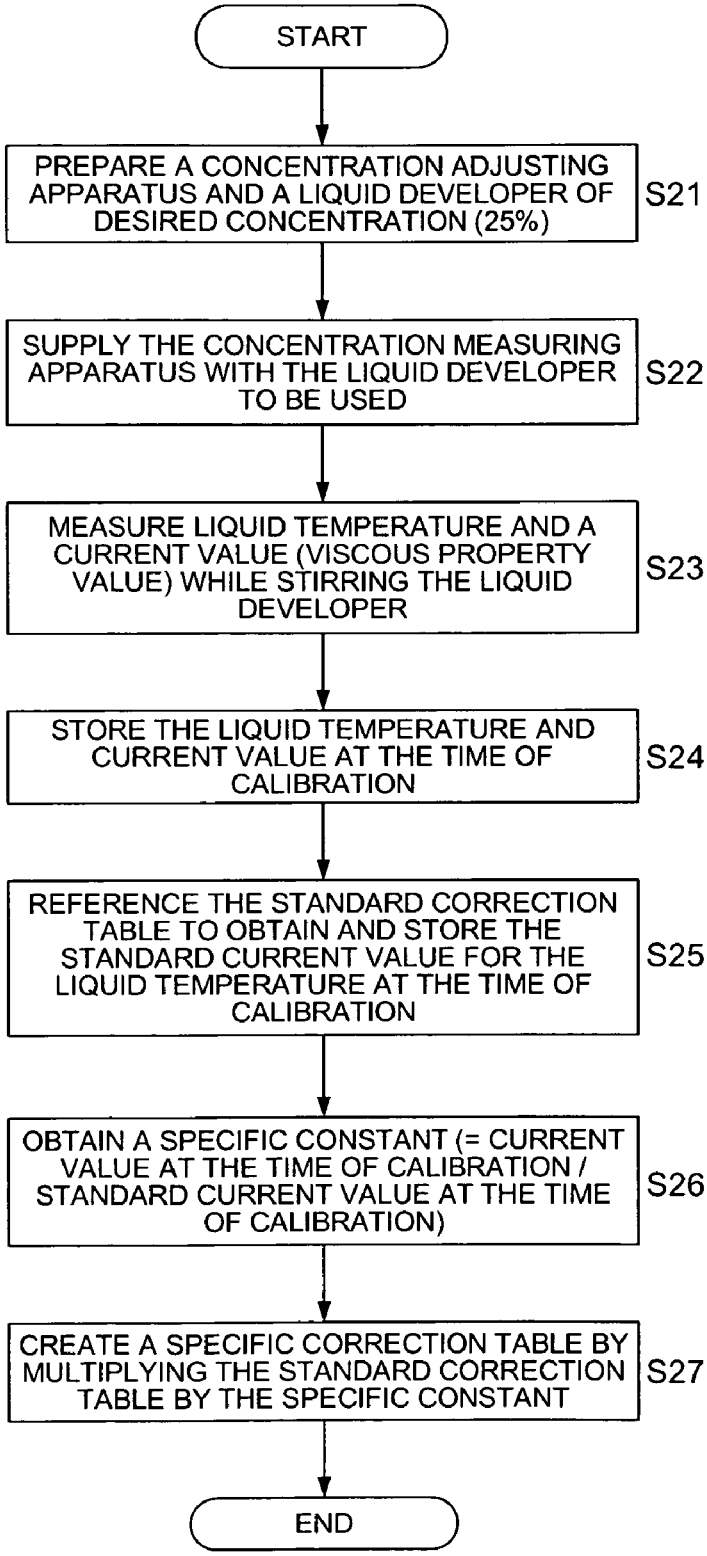
FIG. 10 is a flow chart showing the procedure of calibration for each developer concentration adjusting apparatus, i.e., the procedure of creating the specific correction table separately for each developer concentration adjusting apparatus.
Figure 11:
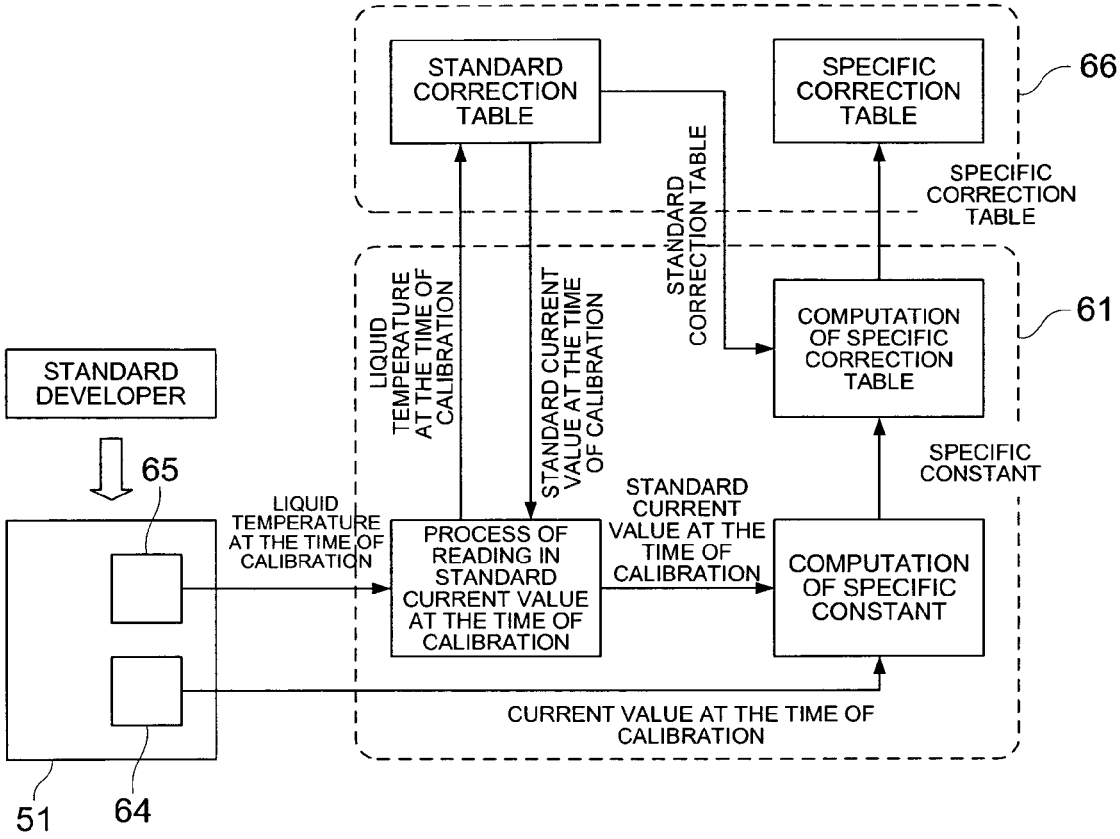
FIG. 11 is a block diagram showing the operation of creating the specific correction table.

FIG. 10 is a flow chart showing the procedure of calibration for each developer concentration adjusting apparatus, i.e., the procedure of creating the specific correction table specialized for each apparatus. FIG. 11 is a block diagram showing the operation of creating the specific correction table in the developer concentration adjusting apparatus.

In Step S21 of FIG. 10, a developer concentration adjusting apparatus and developer of a desired concentration are prepared. They are supposed to be the specific apparatus and the specific developer to create the specific correction table. Thus, all that are to be prepared are the developer concentration adjusting apparatus used for concentration adjustment and the developer used in this apparatus. The developer of the desired concentration can be provided by the use of a new developer to be set.

In Step S22, the liquid developer of the desired toner concentration (25%) to be used is supplied to an apparatus for concentration measurement (the developer concentration measuring section 50). The actual image forming apparatus can be designed in such a structure that the unused liquid developer is set at the time of calibration.

In Step S23, the liquid developer temperature is measured by the temperature detector 65 (step of measuring a liquid temperature). At the same time, the developer is stirred at that liquid temperature and the motor current value (viscosity property value) is measured by the load detector 64 (step of measuring a viscosity property value). The liquid temperature at this time is called the "liquid temperature at the time of calibration", and the current value is called the "current value at the time of calibration"

In Step S24, the liquid temperature at the time of calibration and current value at the time of calibration obtained by the controller 61 are stored in the memory 66.

In Step S25, the controller 61 references the standard correction table in the memory 66 to read out the standard current value corresponding to the liquid temperature at the time of calibration. This is called the "standard current value at the time of calibration". The controller 61 ensures that the standard current value at the time of calibration having been read out is stored into the memory 66.

In Step S26, the controller 61 calculates the specific constant used to create the specific correction table. The formula for that calculation is given by specific constant=current value at the time of calibration/standard current value at the time of calibration.

In Step S27, the controller 61 reads out the standard correction table from the memory 66, and the standard current value at each liquid temperature is multiplied by the specific constant, whereby the target current value is obtained, and the specific correction table showing the relationship between the liquid temperature and the target current value is created. The specific correction table is stored in the memory 66 (second storing step).

This concludes the description of the calibration, i.e., the processing of creating the specific correction table.

<Temperature Correction for Concentration Adjustment>

Figure 12:
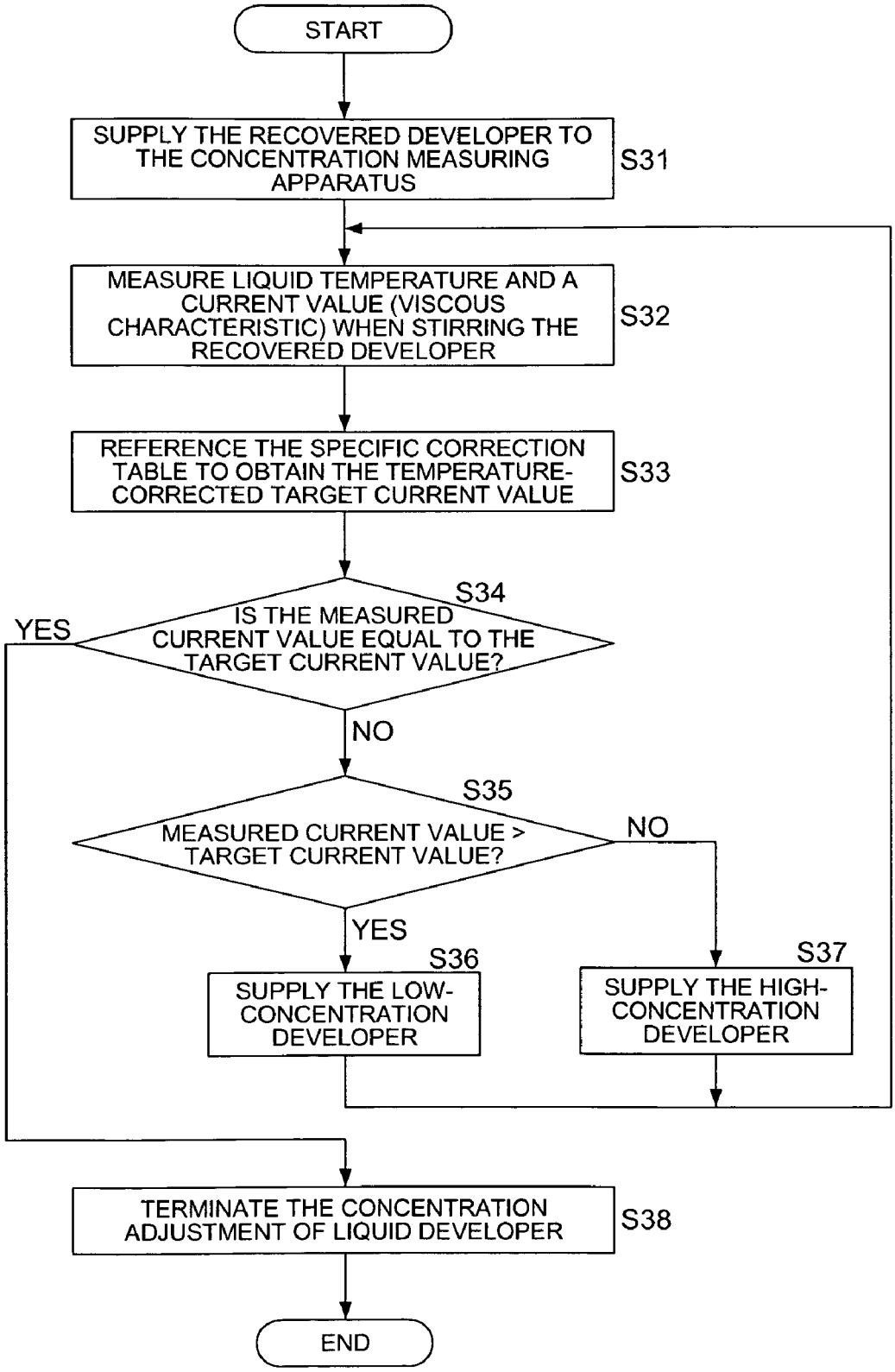
FIG. 12 is a flow chart showing the procedure of temperature correction process for concentration adjustment, which temperature correction process is for each developer concentration adjusting apparatus.
Figure 13:
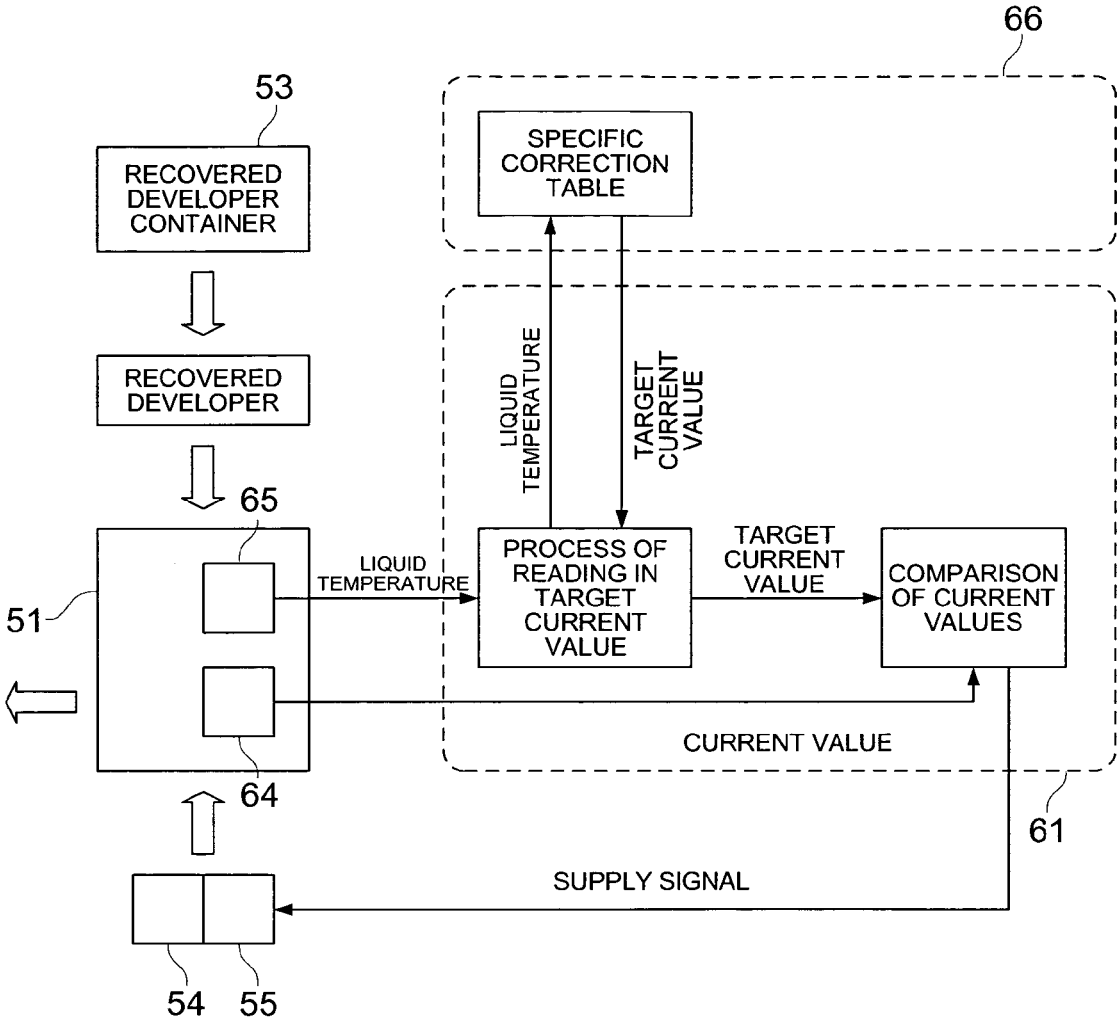
FIG. 13 is a block diagram showing the operation of temperature correction process for concentration adjustment.

FIG. 12 is a flow chart showing the procedure of temperature correction for concentration adjustment to be performed for each developer concentration adjusting apparatus. FIG. 13 is a block diagram showing the operation of temperature correction for concentration adjustment in the developer concentration adjusting apparatus.

In Step S31 of FIG. 12, the developer recovered from the development apparatus is supplied to the developer concentration adjusting apparatus (step of storing a liquid developer in the concentration adjusting container). As described above, the concentration of the recovered developer has been changed, and this developer is used as the concentration-adjusting liquid developer.

In Step S32, the temperature detector 65 measures the liquid developer temperature. At the same time, the developer is stirred at that liquid temperature, and the motor current value (viscosity property value) is measured by the load detector 64 (second measuring step). This is called the "measured current value". The controller 61 gets the measured liquid temperature and measured current value.

In Step S33, the controller 61 references the specific correction table in the memory 66 to read out the target current value for the measured liquid temperature, i.e., the temperature-corrected target current value. The controller 61 stores the target current value having been read out into the memory 66.

In Step S34, the controller 61 compares the measured current value with the target current value. When the measured current value is equal to the target current value (or falls within the tolerance of the preset target current value) (Step S34: YES), there is no need for concentration adjustment. Thus, the process goes to Step S38, and performs the processing for terminating the concentration adjustment. This concludes the process of adjusting the concentration of the recovered developer.

When the measured current value is different from the target current value (or falls outside of the tolerance of the preset target current value) (Step S34: NO), the following Step S35 is executed.

In Step S35, a decision is made to see whether or not the measured current value is greater than the target current value. If the measured current value is greater than the target current value (Step S35: YES), Step S36 will be executed. If the measured current value is smaller than the target current value (Step S35: NO), Step S37 will be executed.

In Step S36, the measured current value is greater than the target current value, namely, the viscosity is higher and the concentration is higher than the target concentration (25%). Accordingly, a supply signal is sent to the second supply developer container) 55 by the controller 61. Then the second supply developer (low-concentration liquid developer (including the case of a carrier solution)) is supplied to the recovered developer in the apparatus (step of supplying a second liquid developer).

In Step S37, the measured current value is smaller than the target current value, namely, the viscosity is lower and the concentration is lower than the target concentration (25%). Accordingly, a supply signal is sent to the first supply developer container 54 by the controller 61. Then the first supply developer (high-concentration liquid developer) is supplied to the recovered developer in the apparatus (step of supplying a first liquid developer).

Upon completion of the supply process in Step S36 or Step S37, the process goes back to Step S32. Then the process repeats the above steps (step of adjusting the concentration) until the measured current value is equal to the target current value (or falls within the tolerance of the preset target current value) in Step S34, which is followed by Step S58.

In Step S38, the concentration of the recovered developer has already been adjusted, and the process will be executed to terminate the concentration adjustment. For example, the recovered developer having been adjusted will be supplied to the developer container 44. Further, new recovered developer is supplied to the developer concentration measuring apparatus 50 from the recovered developer container 53, for example. Then, the next concentration adjustment procedure is repeated.

This completes the description of the process of concentration adjustment including the process of temperature correction.

As described above, in the present embodiment, the concentration of the liquid developer is adjusted such that the viscosity property value of the liquid developer is the target property value.

In this case, the specific correction table used to correct the target viscosity property value according to liquid temperature is created by calibrating the standard correction table determined and stored in advance. Based on this specific correction table, the target viscosity property value is corrected according to the measured temperature, and the concentration of the developer is adjusted such that the measured viscosity property value gets closer to the corrected target viscosity property value.

Despite a slight difference in the toner of liquid developer or a fluctuation in the lot, this arrangement ensures adequate temperature correction by using the specific correction table with consideration given to the difference in the developer. Further, this eliminates the need of storing a great number of tables, and permits easy and high-precision adjustment of the concentration of the liquid developer.

The aforementioned method of concentration adjustment provides easy and high-precision concentration adjustment of the recovered developer in the image forming apparatus, whereby an effective reuse of developer is achieved.

<Correction of Current Value as Stirring Load>

The load for stirring the developer can be obtained by measuring the current value of the motor used to drive the stirring blade. It should be noted, however, that the motor current value may be changed depending on temperature characteristics of the motor. For example, depending on the rise of motor temperature, the current values for the same rotation speed may be different between when the drive by the motor has just started and when a certain period time has passed since the start of the drive. In this case, the temperature characteristics of the motor are preferably corrected.

In the example described below, if the motor current value changes in response to the motor temperature, there is obtained a motor current value for correction in the situation that a predetermined stirring load is driven by a predetermined motor voltage. To be more specific, a step is taken to obtain the current value (no-load stirring current value) in the absence of the concentration-adjusting developer.

Figure 14:
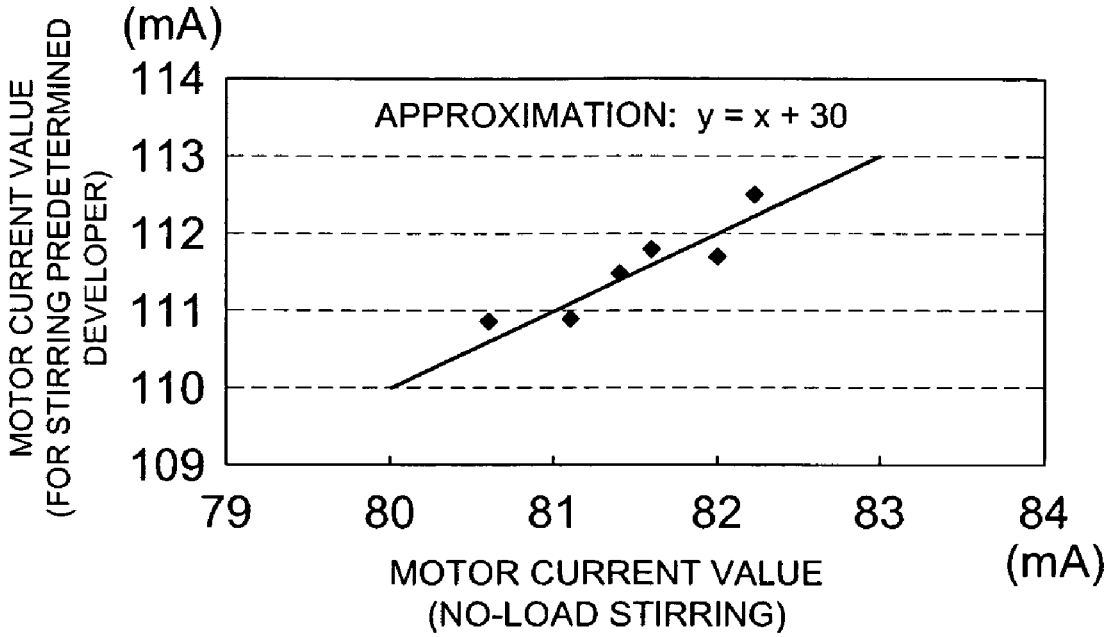
FIG. 14 is a chart showing an example of the relationship between the no-load stirring current value and the current value (target current value) when the developer of a desired concentration is stirred.

FIG. 14 is a chart showing the relationship between the no-load stirring current value (x-axis) and the current value (target current value) (y-axis) when the developer of the desired concentration is stirred.

In FIG. 14, the no-load stirring current value varies in the range approximately from 81.6 mA to 82.2 mA in response to the fluctuation of motor temperature. In response to the fluctuation, the target current value changes in the range approximately from 110.8 mA to 112.5 mA. Accordingly, if the no-load stirring current value is measured when stirring the concentration-adjusting developer, the target current value or measured current value can be corrected based thereon.

In actual practice, the no-load stirring current value cannot be measured when stirring the concentration-adjusting developer. Therefore, when concentration adjustment has started, no-load stirring current value is preferably measured before the developer is supplied into the concentration adjusting container.

1. Target Current Value Correction Method

As can been seen in FIG. 14, one-to-one correspondence is found between a change in no-load stirring current value and a change in the current value at the time of stirring the developer of a predetermined concentration both due to temperature characteristics. To be more specific, the inclination of the line gained by approximating the data in the chart is "1". In terms of approximate expression, Y (target current value)=X (no-load stirring current value)+constant (30 mA in this example).

Thus, when the no-load stirring current value has been measured, the target correction value is assumed as "no-load stirring current value+30" based on the aforementioned approximate expression. This target correction value or target range (=target correction value±tolerance) is compared with the measured current value, and the supply procedure of the supply developers is controlled.

2. How to Correct the Measured Current Value

In the chart of FIG. 14, the approximate expression shows Y (target current value)=X (no-load stirring current value+constant (30 mA in this example). Accordingly, the portion independent of the no-load stirring current value is set as the target value. To be more specific, target set value=target current value (related to the no-load stirring current value)−no-load stirring current value=constant (30 mA in the present example).

The target set value is assumed as the constant (30 mA) and the measured current value is corrected as follows: Corrected measurement value=measured current value−no-load stirring current value.

The aforementioned corrected measurement value is compared with the target set value (30 mA) or the target range (=target set value±tolerance), and the supply procedure of the supply developers is controlled.

(Concentration Adjustment Processing Example 1)

Figure 15:
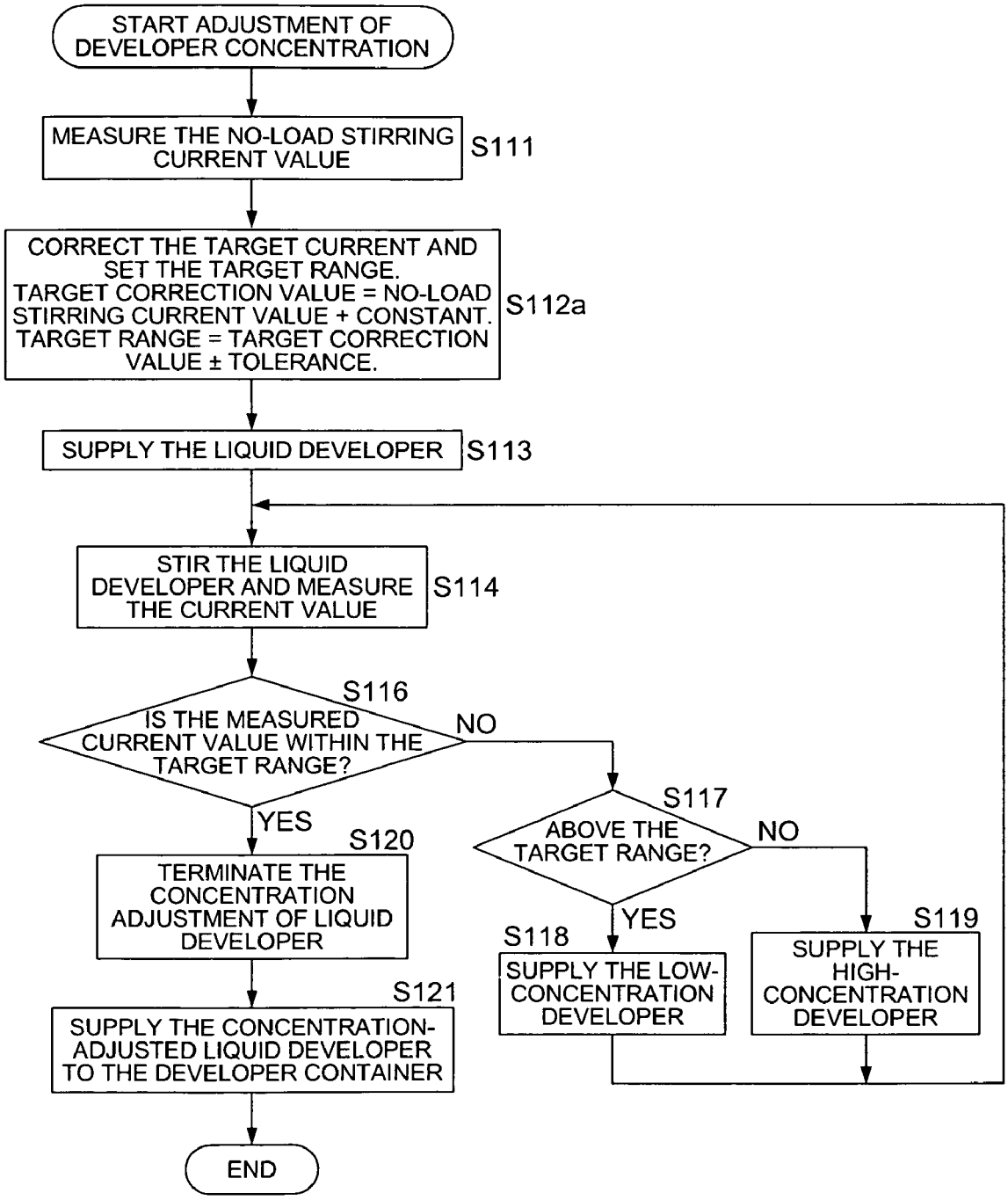
FIG. 15 is a flow chart representing the example 1 of the concentration adjustment of the developer concentration adjusting apparatus.

FIG. 15 is a flow chart representing the processing example 1 of adjusting the concentration in the developer concentration adjusting apparatus. In the processing example 1, it is the target current value that is corrected in the aforementioned procedure of correcting current value. In FIG. 15, the process is executed together with the process of concentration adjustment using the specific correction table described with reference to FIG. 12. However, its description is omitted.

In FIG. 15, when the developer concentration adjustment starts, in Step S111, where the concentration adjusting container 51 is empty, the drive section 63 drives the stirring member 62 according to the instruction from the controller 61, and the stirring operation starts. At the same time, the load detector 64 measures the no-load stirring current value (step of acquiring a no-load stirring current value). In this case, the load detector 64 works as the empty load acquiring portion of the present invention.

This is followed by Step S112*a* wherein the controller 61 as the correcting portion of the present invention corrects the target current value based on the stored approximation and measured no-load stirring current value (step of correcting the target value). In this case, target correction value=no-load stirring current value+constant.

Further, the target range is set based on the target correction value. In this case, target range=target correction value±tolerance.

In Step S113, the concentration-adjusting developer, namely, the recovered developer in the recovered developer container 53 is supplied into the concentration adjusting container 51 as the concentration-adjusting developer.

This is followed by Step S114 wherein the drive section 63 drives the stirring member 62 in response to the instruction from the controller 61, and the concentration-adjusting developer is stirred at a predetermined speed. At the same time, the load detector 64 measures the current value as the stirring load.

In the following Step S116, the measured current value with the concentration-adjusting developer being stirred is compared with the target range based on the target value corrected in Step S112*a*.

If the measured current value is within the target range (Step S116: YES), the process goes to Step S120. To put it another way, the process of concentration adjustment terminates. If the measured current value is out of the target range (Step S116: NO), the process goes to Step S117.

In Step S117, a decision is made to see whether or not the measured current value outside the target range is greater than the target range. If it is greater than the target range (Step S117: YES), Step S118 is executed. If it is below the target range (Step S117: NO), Step S119 is executed.

In Step S118, the measured concentration of the concentration-adjusting developer is greater than the target concentration, and therefore, the second supply developer (low-concentration developer) is supplied. Then, the process goes back to Step S114 and the procedure is repeated from the load detection (step of adjusting concentration).

In Step S119, the measured concentration of the concentration-adjusting developer is below the target concentration, and therefore, the first supply developer (high-concentration developer) is supplied. Then the process goes back to Step S114 and the procedure is repeated from the load detection (step of adjusting concentration).

When the process exits the repeated operations from Step S116, and the adjustment is terminated in Step S120, Step S121 is executed to discharge the concentration-adjusted developer from the concentration adjusting container 51, whereby the developer is supplied to the developer container 44 to be used for development (step of discharging).

This makes the concentration adjusting container 51 empty, so that a no-load stirring load can be detected for the next concentration adjustment before the liquid developer is supplied.

(Concentration Adjustment Processing Example 2)

Figure 16:
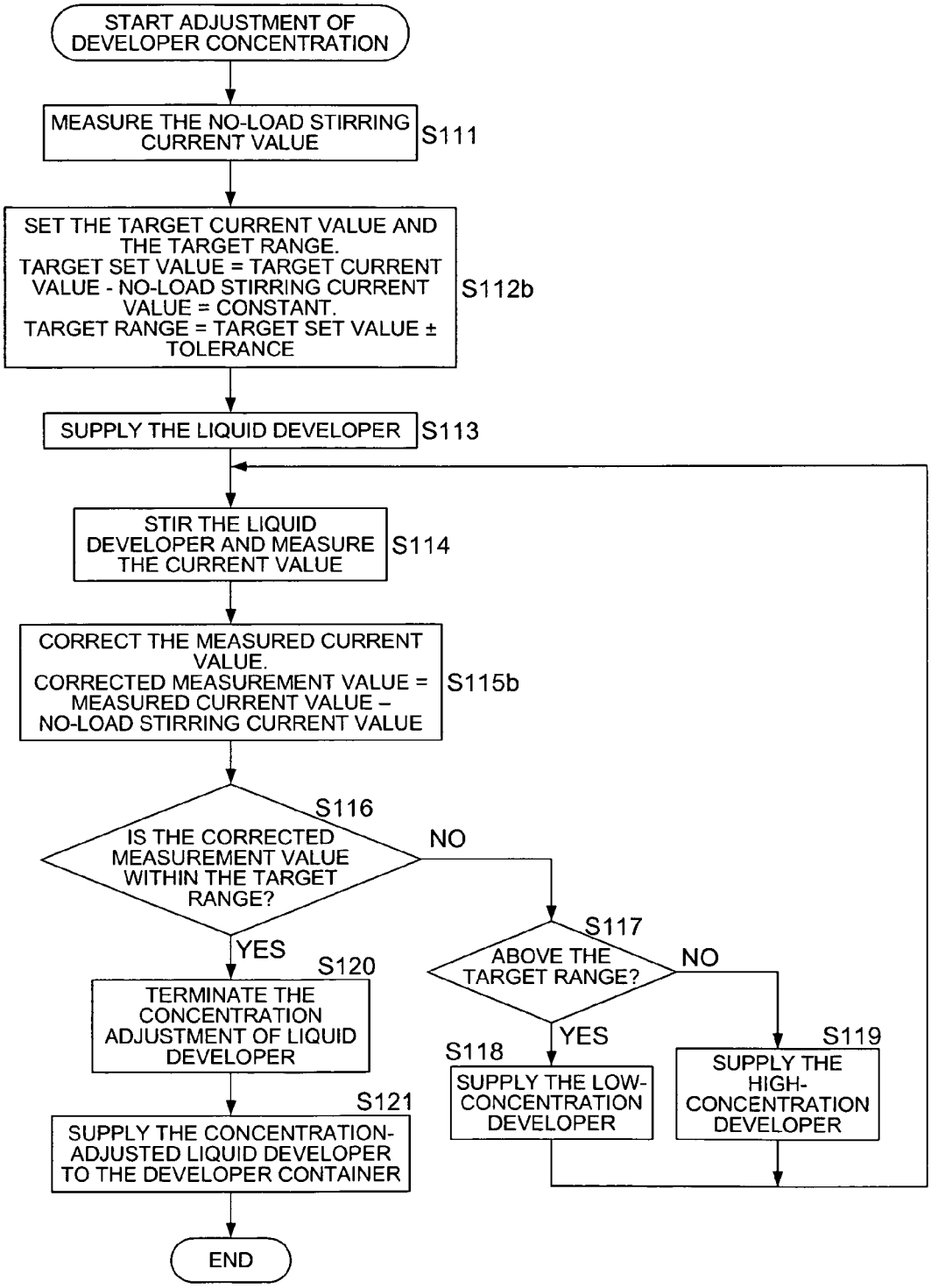
FIG. 16 is a flow chart representing the example 2 of the concentration adjustment of the developer concentration adjusting apparatus.

FIG. 16 is a flow chart representing the processing example 2 of adjusting the concentration in the developer concentration adjusting apparatus. In the processing example 2, it is the measured current value that is corrected in the aforementioned procedure of correcting current value. In FIG. 16 as well, the process is executed together with the process of concentration adjustment using the specific correction table described with reference to FIG. 12. However, its description is omitted.

In FIG. 16, when the adjustment of developer concentration starts, in Step S111, where the concentration adjusting container 51 is empty, the drive section 63 drives the stirring member 62, and the stirring operation starts. At the same time, the load detector 64 measures the no-load stirring current value.

This is followed by Step S112*b* wherein the target current value is set based on the approximation stored in the controller 61. In this case, target set value=target current value−no-load stirring current value=constant.

To put it another way, the constant portion of the approximation is assumed as the target set value.

Further, the target range is set based on the target correction value. In this case, target range=target set value (constant) ±tolerance.

In Step S113, the concentration-adjusting developer, namely, the recovered developer in the recovered developer container 53, is supplied into the concentration adjusting container 51 as the concentration-adjusting developer.

This is followed by Step S114 wherein the drive section 63 drives the stirring member 62, and starts stirring of the concentration-adjusting developer, at a predetermined speed. At the same time, the load detector 64 measures the current value as the stirring load.

This is followed by Step S115*b* wherein the measured current value is corrected. In conformity to the target value set in Step S112*b*, the no-load stirring current value is subtracted, and the corrected measurement value is obtained as the following equation (step of correcting the detected current value). Corrected measurement value=measured current value−no-load stirring current value.

The Steps after Step S116 are the same as the Steps of the same numbers in FIG. 15, and will not be described to avoid duplication. The difference between the processing example 1 and processing example 2 is found only in the aforementioned portion for correcting the current value.

As described above, in the processing examples 1 and 2, the stirring load is measured in terms of the drive motor current value, whereby the no-load stirring current value in the empty state without liquid developer is detected for adjustment of the liquid developer viscosity (concentration), and the measured current value and/or target current value is corrected based on this value. This arrangement reduces the measuring error factor caused by motor temperature characteristics and improves the accuracy of concentration adjustment.

In the embodiment related to the liquid developer concentration adjusting apparatus of the present invention and the method thereof, a viscosity property value is used to adjust the concentration of the liquid developer, and the concentration is adjusted as follows, by way of an example: A predetermined standard correction table is calibrated according to the liquid temperature, and a specific correction table is created. Based on this specific correction table, a target viscosity property value corrected at the measured liquid temperature is compared with a measured viscosity property value, and the measured viscosity property value is adjusted to a greater or smaller level.

This arrangement makes it possible to identify the difference in the developer even when there is a slight difference in the toner of liquid developer, or a lot-to-lot fluctuation occurs in toner. This arrangement also simplifies the mechanism for exchanging information on the developer, and eliminates the need of storing a great number of tables. Thus, the viscosity property value which is adequately temperature-corrected in conformity to each liquid developer can be calculated, and the easy and high-precision adjustment of the concentration of liquid developer is ensured.

It is to be expressly understood, that the present invention is not restricted to the aforementioned embodiments. The present invention can be embodied in a great number of variations with appropriate modification or additions, without departing from the technological spirit and scope of the invention claimed.

What is claimed is:

1. A liquid developer concentration adjusting apparatus, comprising:

a concentration adjusting container;

a developer supplying mechanism which is connected to the concentration adjusting container and is adapted to supply the concentration adjusting container with a liquid developer whose concentration is to be adjusted;

a viscosity detector for detecting a viscosity property value which depends on concentration of a liquid developer in the concentration adjusting container;

a temperature detector for detecting a temperature of a liquid developer in the concentration adjusting container;

a memory which is adapted to store a standard correction table indicating a relationship between a viscosity property value of a predetermined standard liquid developer and temperature thereof;

a calibration portion which is adapted to correct the standard correction table to make a specific correction table based on outputs of the viscosity detector and the temperature detector while the concentration adjusting container is filled with a standard liquid developer for calibration;

a concentration adjusting mechanism which is adapted to adjust concentration of a liquid developer in the concentration adjusting container based on the temperature of the liquid developer in the concentration adjusting container and the specific correction table such that a viscosity property value of the liquid developer is a desired value.

2. The liquid developer concentration adjusting apparatus of claim 1, wherein the concentration adjusting mechanism includes:

a first liquid supplying mechanism which is connected to the concentration adjusting container and is adapted to supply the concentration adjusting container with a first supply liquid whose concentration is higher than a desired concentration;

a second liquid supplying mechanism which is connected to the concentration adjusting container and is adapted to supply the concentration adjusting container with a second supply liquid whose concentration is lower than the desired concentration; and a controller which is adapted to control supply of the first supply liquid by the first liquid supplying mechanism or supply of the second supply liquid by the second liquid supplying mechanism so that an output value of the viscosity detector is a target value obtained from the specific correction table in view of an output of the temperature detector.

3. The liquid developer concentration adjusting apparatus of claim 1, comprising:

a stirring mechanism which is adapted to stir a liquid developer stored in the concentration adjusting container.

4. The liquid developer concentration adjusting apparatus of claim 3, wherein the viscosity detector detects a stirring load as a viscosity property value when the stirring mechanism is stirring the liquid developer.

5. The liquid developer concentration adjusting apparatus of claim 4, wherein the stirring mechanism includes:

a stirring blade; and a motor for driving the stirring blade, wherein the viscosity detector detects a current value of the motor as the viscosity property value when the stirring mechanism is stirring the liquid developer.

6. The liquid developer concentration adjusting apparatus of claim 5, comprising:

an empty load acquiring portion which is adapted to acquire a no-load stirring current value which is an output value of the viscosity detector while the concentration adjusting container is empty, wherein the controller corrects, based on the no-load stirring current value, the viscosity property value and/or the target value to be used by the concentration adjusting mechanism.

7. The liquid developer concentration adjusting apparatus of claim 1, wherein letting a ratio of the viscosity property value of the liquid developer for calibration measured by the viscosity detector to a standard viscosity property value of liquid developer for a temperature of the liquid developer for calibration measured by the temperature detector be a specific constant, the calibration portion creates the specific correction table by multiplying a viscosity property value for each temperature on the standard correction table by the specific constant.

8. The liquid developer concentration adjusting apparatus of claim 1, wherein the concentration adjusting container includes:

a wall having an opening, wherein the concentration adjusting mechanism adjusts the concentration of the liquid developer such that the viscosity, which is measured while excessive liquid developer is overflowing through the opening, is the desired value.

9. A liquid developer concentration adjusting method for adjusting concentration of a liquid developer stored in a concentration adjusting container, the method comprising the steps of:

a first storing step of storing in a memory a standard correction table, on which a relationship between a viscosity property value of a predetermined standard liquid developer and temperature thereof;

a first measuring step of measuring a viscosity property value of a liquid developer for calibration and temperature thereof while the concentration adjusting container is filled with the liquid developer for calibration;

a second storing step of storing a specific correction table in the memory after creating the specific correction table by correcting the standard correction table based on the measured viscosity property value of the liquid developer for calibration and the measured temperature thereof;

storing in the concentration adjusting container a liquid developer whose concentration is to be adjusted;

a second measuring step of measuring a viscosity of liquid developer and temperature of the liquid developer whose concentration is to be adjusted; and an adjusting step of adjusting concentration, based on the temperature measured by the second measuring step and the specific correction table, such that the viscosity property value of the liquid developer, whose concentration is to be adjusted, to be a desired value for the measured temperature of the liquid developer whose concentration is to be adjusted.

10. The liquid developer concentration adjusting method of claim 9, wherein the adjusting step includes the steps of:

supplying a first liquid developer, whose concentration is higher than a desired concentration, to the concentration adjusting container when the viscosity property value of the liquid developer whose concentration is to be adjusted is smaller than the desired value; and supplying a second liquid developer, whose concentration is lower than the desired concentration, to the concentration adjusting container when the viscosity property value of the liquid developer whose concentration is to be adjusted is greater than the desired value.

11. The liquid developer concentration adjusting method of claim 9, comprising the step of:

stirring a liquid developer stored in the concentration adjusting container.

12. The liquid developer concentration adjusting method of claim 11, wherein in the first measuring step and the second measuring step, a stirring load of the liquid developer is detected as a viscosity property.

13. The liquid developer concentration adjusting method of claim 9, wherein in the second storing step, letting a ratio of the viscosity property value of the liquid developer for calibration to a viscosity property value of the standard liquid developer at the temperature of the liquid developer for calibration be a specific constant, the specific correction table is created by multiplying each viscosity value for each temperature on the standard correction table by the specific constant.

14. The liquid developer concentration adjusting method of claim 9, wherein in the adjusting step, the concentration of the liquid developer is adjusted such that the concentration property value, which is measured while an excessive liquid developer is overflowing through an opening of the concentration adjusting container, is the desired value.

15. A liquid developer concentration adjusting apparatus, comprising:

a concentration adjusting container;

a developer supplying mechanism which is connected to the concentration adjusting container and is adapted to supply the concentration adjusting container with a liquid developer whose concentration is to be adjusted;

a stirring mechanism which is adapted to stir a liquid developer stored in the concentration adjusting container, the stirring mechanism having a motor as a driving source, a load detector which is adapted to detect a current value of the motor to obtain a stirring load of the stirring mechanism;

a concentration adjusting mechanism which is adapted to adjust concentration of the liquid developer such that a current value detected by the load detector is a desired target value;

an empty load acquiring portion which is adapted to acquire a no-load stirring current which is an output of the load detector while the concentration adjusting container is empty; and a correcting portion which is adapted to correct a current value detected by the load detector and/or the desired target value based on the no-load stirring current, wherein the concentration adjusting mechanism adjusts the concentration of the liquid developer based on the current value and/or the target value corrected by the correcting portion.

16. The liquid developer concentration adjusting apparatus of claim 15, wherein every time the concentration adjusting mechanism needs to conduct a concentration adjustment, the empty load acquiring portion acquires a no-load stirring current, while the concentration adjusting container is empty, before the concentration adjusting container is filled with a liquid developer.

17. The liquid developer concentration adjusting apparatus of claim 15, wherein the concentration adjusting mechanism includes:

a first liquid supplying mechanism which is connected to the concentration adjusting container and is adapted to supply the concentration adjusting container with a first supply liquid whose concentration is higher than a desired concentration;

a second liquid supplying mechanism which is connected to the concentration adjusting container and is adapted to supply the concentration adjusting container with a second supply liquid whose concentration is lower than a desired concentration; and a controller which is adapted to control supply of the first supply liquid by the first supplying mechanism and supply of the second supply liquid by the second supplying mechanism based on the current value and/or the target value corrected by the correcting portion.

18. The liquid developer concentration adjusting apparatus of claim 15, wherein the concentration adjusting container includes:

a wall having an opening, wherein the concentration adjusting mechanism adjusts the concentration of the liquid developer such that a current value, which is detected while an excessive liquid developer is overflowing through the opening, is the target value.

19. A liquid developer concentration adjusting method for adjusting concentration of liquid developer to be a desired value by detecting a current of a motor included in a stirring mechanism for stirring a liquid developer stored in a concentration adjusting container, the method comprising the steps of:

acquiring a no-load stirring current value which is a current value of the motor while the concentration adjusting container is empty;

supplying the concentration adjusting container with a liquid developer whose concentration is to be adjusted;

detecting a current value of the motor while stirring the liquid developer stored in the concentration adjusting container with the stirring mechanism;

adjusting concentration of the liquid developer in the concentration adjusting container such that the detected current value is a desired value;

correcting, before the step of adjusting concentration, the detected current value and/or the target value by using the no-load stirring current; and discharging from the concentration adjusting container the liquid developer whose concentration has been adjusted.

20. The method of claim 19, wherein the step of adjusting concentration includes the steps of:

supplying, when the current of the motor detected in the step of detecting a current value is smaller than the target value, the concentration adjusting container with a first supply liquid whose concentration is higher than the desired value; and supplying, when the current of the motor detected in the step of detecting a current value is greater than the target value, the concentration adjusting container with a second supply liquid whose concentration is lower than the desired value.

21. The method of claim 19, wherein in the step of adjusting concentration, the concentration of the liquid developer is adjusted such that the current, which is detected while an excessive liquid developer is overflowing through an opening of the concentration adjusting container, is the target value.

* * * * *